US011591863B2

(12) United States Patent
Basile et al.

(10) Patent No.: US 11,591,863 B2
(45) Date of Patent: Feb. 28, 2023

(54) MULTIFUNCTION HANDLER FOR HANDLING DRILLING ELEMENTS IN A DRILLING RIG, DRILLING RIG AND RELATED METHODS FOR HANDLING DRILLING ELEMENTS

(71) Applicant: DRILLMEC INC., Houston, TX (US)

(72) Inventors: Adolfo Basile, The Woodlands, TX (US); Andrea Tiberi, Magnolia, TX (US)

(73) Assignee: DRILLMEC INC., Houston, TX (US)

( * ) Notice: Subject to any disclaimer, the term of this patent is extended or adjusted under 35 U.S.C. 154(b) by 0 days.

(21) Appl. No.: 17/050,378

(22) PCT Filed: Apr. 24, 2019

(86) PCT No.: PCT/IB2019/053364
§ 371 (c)(1),
(2) Date: Oct. 23, 2020

(87) PCT Pub. No.: WO2019/207493
PCT Pub. Date: Oct. 31, 2019

(65) Prior Publication Data

US 2021/0054700 A1 Feb. 25, 2021

(30) Foreign Application Priority Data

Apr. 27, 2018 (IT) ..... 102018000004926

(51) Int. Cl.
*E21B 19/15* (2006.01)
*E21B 15/00* (2006.01)

(52) U.S. Cl.
CPC ..... *E21B 19/155* (2013.01); *E21B 15/00* (2013.01)

(58) Field of Classification Search
CPC ..... E21B 19/14; E21B 19/15; E21B 19/19155
See application file for complete search history.

(56) References Cited

U.S. PATENT DOCUMENTS 4,274,778 A 6/1981 Putnam et al.
5,423,390 A * 6/1995 Donnally ..... E21B 19/14 175/85

(Continued)

FOREIGN PATENT DOCUMENTS

EP 2799661 A2 11/2014
WO 2010/141231 A2 12/2010

(Continued)

OTHER PUBLICATIONS

NOV Rig Technologies, Product Reference Guide; 2018, pp. 26, 29 (Year: 2018).*

(Continued)

*Primary Examiner* — Lynn E Schwenning
(74) *Attorney, Agent, or Firm* — Merchant & Gould P.C.

(57) ABSTRACT

A multifunction handler for handling drilling elements in a drilling rig includes a slide, which has a guide system and a lifting system. The slide is adapted to slide along a first axis parallel to the longitudinal extension of a drilling rig mast. An articulated arm, a robotic apparatus, and a handling head are adapted to seize, hold and release a drilling element. The articulated arm is fixed at a first end to the slide. A first end of the robotic apparatus is fixed to the second end of the articulated arm. The articulated arm allows moving the robotic apparatus along a second axis perpendicular to the first axis. The handling head connects to the second end of the robotic apparatus. The robotic apparatus moves the handling head with at least three degrees of freedom and the handler moves the handling head with at least five degrees of freedom.

14 Claims, 13 Drawing Sheets

(56) References Cited

U.S. PATENT DOCUMENTS

| | | | | |
|---|---|---|---|---|
| 5,941,324 | A | 8/1999 | Bennett | |
| 7,878,254 | B2 * | 2/2011 | Abdollahi | E21B 19/14 166/85.1 |
| 8,397,837 | B2 * | 3/2013 | Skogerbo | E21B 19/155 166/341 |
| 8,550,761 | B2 * | 10/2013 | Belik | E21B 19/155 414/22.63 |
| 9,309,728 | B2 * | 4/2016 | Reddy | E21B 3/02 |
| 9,926,753 | B2 * | 3/2018 | Magnuson | E21B 19/14 |
| 10,196,867 | B2 * | 2/2019 | Mally | G01B 11/272 |
| 10,465,455 | B2 * | 11/2019 | Berry | E21B 19/14 |
| 11,041,346 | B2 * | 6/2021 | Mikalsen | E21B 19/15 |
| 2010/0326672 | A1 * | 12/2010 | Childers | E21B 19/20 166/380 |
| 2014/0133939 | A1 | 5/2014 | Richardson et al. | |
| 2017/0306710 | A1 | 10/2017 | Trydal et al. | |
| 2019/0003269 | A1 * | 1/2019 | Skjærseth | B25J 15/0033 |

FOREIGN PATENT DOCUMENTS

| | | | |
|---|---|---|---|
| WO | 2014/098708 | A1 | 6/2014 |
| WO | 2016/094022 | A1 | 6/2016 |
| WO | 2017/087349 | A1 | 5/2017 |

OTHER PUBLICATIONS

International Search Report and Written Opinion for PCT/IB2019/053364, dated Jun. 24, 2019.

* cited by examiner

Fig. 9C
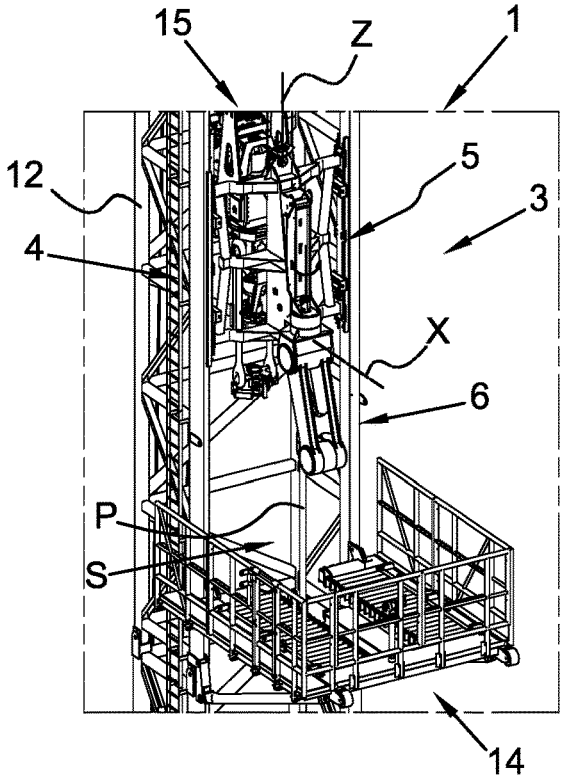
Fig. 9D
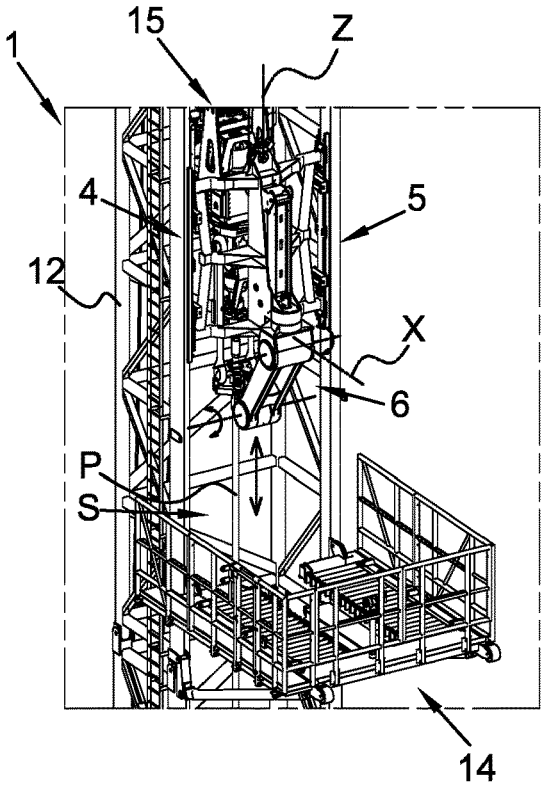
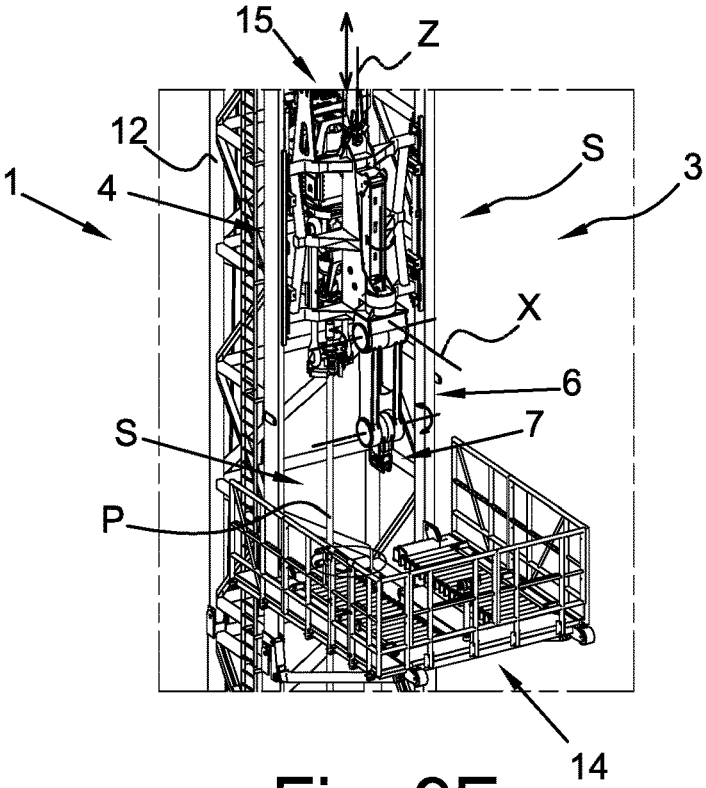
Fig. 9E

MULTIFUNCTION HANDLER FOR HANDLING DRILLING ELEMENTS IN A DRILLING RIG, DRILLING RIG AND RELATED METHODS FOR HANDLING DRILLING ELEMENTS

This application is a National Stage Application of International Application No. PCT/IB2019/053364, filed Apr. 24, 2019, which claims benefit of priority to Ser. No. 10/201, 8000004926, filed Apr. 27, 2018 in Italy and which applications are incorporated herein by reference. To the extent appropriate, a claim of priority is made to each of the above-disclosed applications.

BACKGROUND OF THE INVENTION

The present invention relates to a multifunction handler capable of handling drilling elements, such as drill pipes, drill collars, heavy weight drill pipes, or well protection elements, such as casings, in different operating configurations of the drilling rig.

The present invention further relates to a handling system for drilling rigs, which can eliminate the human component from the drill floor and from the fingerboard where drilling elements are racked.

The present invention further relates to an innovative drilling rig comprising the handler and/or the handling system according to the present invention.

The present invention further relates to innovative methods of moving drilling elements through the use of the handler according to the present invention.

Drilling rigs are known which comprise a plurality of handlers, each one specially designed to perform a specific function in a specific area of the drilling rig.

Patent application WO2010141231A2 describes a system for transferring pipes, including tubular elements such as drill pipes, drill collars and heavy weight drill pipes, or protection elements such as casings, from one location to another within the rig, in particular from the fingerboard towards the well centre.

From U.S. Pat. No. 4,274,778A it is also known to employ two handlers, one of which is located in a specific position on the drill floor and the other is located on the fingerboard, which co-operate to move the pipes from the fingerboard towards the well centre.

Patent application WO2017087349 describes a plurality of different handlers adapted to appropriately handle a large number of pipes in a large fingerboard.

Patent application WO2016094022 describes a handling system comprising a movable column on the drill floor, whereto a plurality of handlers are connected which allow reducing the number of human operators on the drill floor and on the fingerboard.

The above-described solutions are costly solutions that only allow handling drill pipes through particular sections and/or for performing specific functions.

No handlers are known which can perform operations such as those referred to in technical jargon as "off-line" operations, i.e. during procedures not directly related to drilling, e.g. assembling or disassembling a stand of drill pipes from the ground up to the fingerboard or magazine, and also the feeding step during the drilling procedure, wherein drill pipes, e.g. in the form of a stand of pipes, are brought from the fingerboard or magazine to the well centre or to the mouse hole to be then picked up and used during the drilling phases, and vice versa.

The individual handlers currently in use in drilling rigs have a limited number of degrees of freedom, since they have been designed to perform only one specific function within the drilling rig. Excluding any degrees of freedom of a handling head, such handlers have three degrees of freedom at most.

SUMMARY OF THE INVENTION

The present invention aims at solving all of the above-mentioned technical problems, in addition to other technical problems known to a person skilled in the art.

In particular, the present invention aims at providing a multifunction handler capable of performing pipe handling operations both during the drilling phase and during the pipe assembling/disassembling phase, in particular the off-line procedures of the drilling rig.

The present invention also aims at reducing, in particular eliminating, the number of human operators by automating the handling of the pipes by means of an innovative handling system.

One aspect of the present invention relates to a multifunction handler having the features set out in the appended claim 1.

Another aspect relates to a handling system having the features set out in the appended claim 8.

A further aspect of the present invention relates to a drilling rig having the features set out in the appended claim 12.

A further aspect of the present invention relates to a method of assembling drilling elements having the features set out in the appended claim 14.

A further aspect of the present invention relates to a first method of moving drilling elements having the features set out in the appended claim 15.

A further aspect of the present invention relates to a second method of moving drilling elements having the features set out in the appended claim 16.

BRIEF DESCRIPTION OF THE DRAWINGS

The features and advantages of the handler, system, rig and methods will become apparent in the light of the following description of several possible embodiments and of the annexed drawings, wherein:

FIG. 1A shows a side view of the handler in a possible operating configuration; FIG. 1B schematically shows the control system of the same handler;

FIG. 3A shows the handler in a first configuration of the handling head, such position being attained by means of a robotic apparatus; FIG. 3B shows the handler in a second configuration, in which the handling head is rotated about an axis parallel to a vertical axis, compared to said FIG. 3A; FIG. 3C shows the handler in a third configuration, in which the handling head is rotated about an axis parallel to the vertical axis, compared to said FIGS. 3A and 3B; FIG. 3D shows the handler with the articulated arm in an extended configuration, compared to said FIGS. 3A-3C;

FIG. 4A shows the handler in a first configuration of the handling head, taken by means of the robotic apparatus and an articulated arm; FIG. 4B shows the handler in a second configuration, in which the handling head is rotated about an axis parallel to a vertical axis, compared to said FIG. 4A; FIG. 4C shows the handler with said articulated arm in an extended configuration, compared to FIG. 4A;

FIG. 5A shows the drilling rig in a side view; FIG. 5B shows the same drilling rig in a top plane view;

FIG. 6A shows a handler seizing a drilling element located near the drill floor by means of a lifting device or catwalk; FIG. 6B shows the handler lifting the drilling element seized in FIG. 6A; FIG. 6C shows the handler placing the drilling element into a vertical position; FIG. 6D shows the handler bringing the drilling element, arranged vertically as shown in FIG. 6C, towards the well;

FIG. 7A shows the positioning of a first drilling element into a well by means of said handler; FIG. 7B shows the positioning of a second drilling element to be connected and tightened to the first drilling element located in the well; FIG. 7C shows the assembly consisting of the first and second drilling elements being moved into the well by said handler; FIG. 7D shows the positioning of a third drilling element to be connected and tightened to the assembly consisting of the first and second drilling elements located in the well, for the purpose of creating a stand; FIG. 7E shows a side view of the handler supporting a stand made up of three drilling elements connected together;

FIG. 8A shows the handler lifting the stand of drilling elements, so that one end arrives at the fingerboard comprised in the drilling rig, while remaining aligned with the axis of a well; FIG. 8B shows the stand of drilling elements being offset relative to the axis of the well by said handler; FIG. 8C shows the reversal of the orientation of the handling head of the handler, compared to the configuration shown in FIG. 8B;

FIG. 8D shows the stand of drilling elements being moved by said handler to an appropriate housing comprised in the fingerboard;

FIGS. 9A-9E show, in axonometric views, the handling of the stand of drilling elements from a fingerboard to a well; in particular, FIG. 9A shows a stand of drilling elements, placed in the housing of the fingerboard, being seized and lifted by the handler; FIG. 9B shows the stand of drilling elements being placed by the handler in an area where it is less of a hindrance; FIG. 9C shows the reversal of the orientation of the handling head of the handler, compared to the configuration shown in FIG. 9B; FIG. 9D shows the stand of drilling elements being moved by the handler towards the top drive in alignment with a well;

FIG. 9E shows the handler after it has released the stand of drilling elements, which is now supported by the top drive;

FIG. 10A shows a front view of the drill floor and robotized arm in one possible operating configuration; FIG. 10B shows a side view of the robotized arm on the drill floor;

FIG. 11A shows the robotized arm in a first configuration at a first end of a guide; FIG. 11B shows the robotized arm in a second configuration at a second end of the guide.

Figure 2:
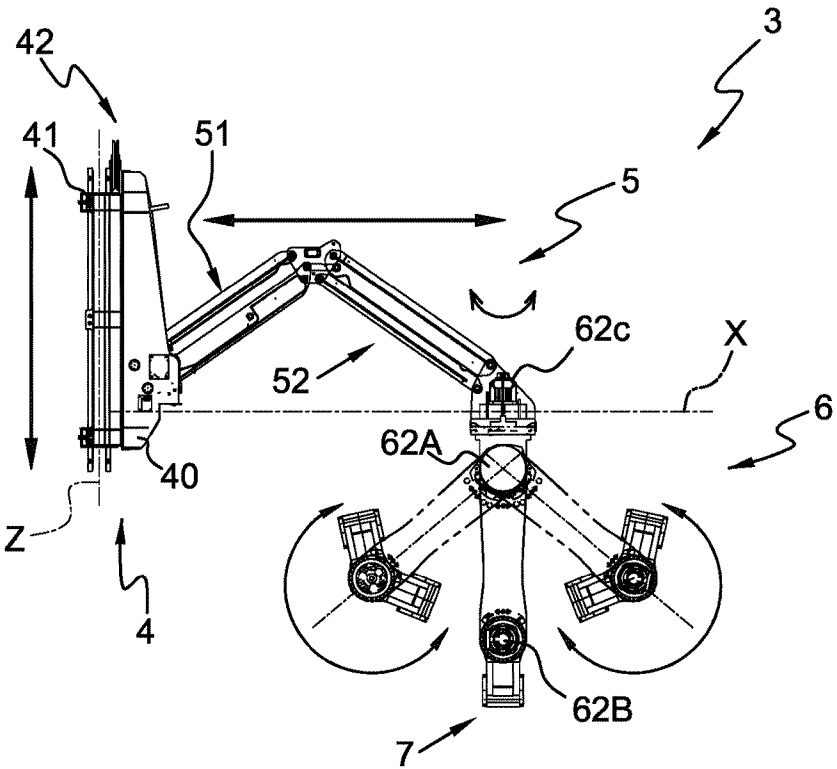
FIG. 2 shows an overlay view of the handler of FIG. 1A, in particular of the robotic apparatus, in different possible operating configurations, with indications about the possible directions of movement of the various parts of the handler.

With reference to the above-mentioned figures, reference numeral 3 designates as a whole the multifunction handler according to the present invention; while reference numeral 1 designates as a whole the drilling rig, in which the handler is comprised.

Multifunction handler 3 is particularly suitable for handling drilling elements "P" in a drilling rig 1.

For the purposes of the present invention, the term drilling elements refers to drill pipes, drill collars and heavy weight drill pipes, as well as to pipes to be used for consolidating the wellbore, also known as casings. For simplicity's sake, in the following description the term drilling elements will be used to indicate, without distinction, any rods or pipes commonly employed in drilling rigs, unless otherwise specified.

Handler 3 according to the present invention comprises a slide 4. Said slide 4 comprises, in turn, a guide system 41 and a lifting system 42.

Said slide 4 is adapted to slide along a first axis "Z". Said axis "Z" is parallel to the longitudinal extension axis of a mast 12 comprised in drilling rig 1. Said axis "Z" is preferably a vertical axis.

Handler 3 according to the present invention further comprises an articulated arm 5, a robotic apparatus 6, and a handling head 7.

Said handling head 7 is adapted to at least seize, hold and appropriately release at least one drilling element "P".

Said articulated arm 5 is fixed at a first end thereof to said slide 4.

A first end of said robotic apparatus 6 is fixed to the second end of said articulated arm 5.

Said articulated arm 5 is adapted to allow moving robotic apparatus 6 along at least a second axis "X". Said second axis "X" is preferably perpendicular to said axis "Z" along which said slide 4 slides.

As aforementioned, said robotic apparatus 6 is connected, at a first end thereof, to the second end of articulated arm 5. Said handling head 7 is connected to the second end of robotic apparatus 6.

Said robotic apparatus 6, comprised in handler 3 according to the present invention, is adapted to move said handling head 7 with at least three degrees of freedom.

In general, said handler 3 according to the present invention is configured for moving said handling head 7 with at least five degrees of freedom.

In general, handler 3 according to the present invention is designed to adapt itself to different handling requirements of drilling elements "P". The handling of drilling elements "P" effected by handler 3 is adaptive, so that the peak forces acting upon handler 3 are always as small as possible, in order to reduce any twisting effects on the structure of handler 3 and/or on drilling elements "P", as well as on drilling rig 1.

In a preferred, but non-limiting, embodiment of handler 3 according to the present invention, said robotic apparatus 6 comprises at least three electric motors 62. Said at least three electric motors 62 are adapted to operate on three axes. Said three axes are distinct from one another. In particular, said motors are adapted to operate on at least three different axes, thus providing at least three different degrees of freedom. Therefore, said at least three axes are not coaxial. Preferably, said electric motors 62 are brushless motors.

Handler 3 according to the present invention comprises a control system 32. Said control system 32 is adapted to independently control said electric motors 62 comprised in robotic apparatus 6.

The use of electric motors allows for faster, simpler and more reliable control of the movements of robotic apparatus 6, compared to the hydraulic solutions normally employed in prior-art handlers. Moreover, the use of electric motors facilitates the assembling of handler 3, thus reducing the manufacturing costs and making handler 3 easier to design, since the latter is more nimble, less bulky and altogether lighter than a hydraulic handler, the number of degrees of freedom being the same.

In one possible exemplary, but non-limiting, embodiment of handler 3 according to the present invention, said robotic apparatus 6 comprises: a first electric motor 62A, a second electric motor 62B, and a third electric motor 62C.

Said first electric motor 62A is adapted to cause said handling head 7 to rotate about a first horizontal axis, perpendicular to said axis "Z". The same first horizontal axis may be parallel to the second axis "X", depending on the operating configuration taken by handler 3.

Said second electric motor 62B is adapted to cause said handling head 7 to rotate about a second horizontal axis, wherein said second horizontal axis being parallel to said first horizontal axis.

Said third electric motor 62C is adapted to cause said handling head 7 to rotate about a first vertical axis, e.g. parallel to said axis "Z".

Said three electric motors (62A, 62B and 62C) are adapted to provide said handling head 7 with three different degrees of freedom.

Preferably, said control system 32, comprised in said handler 3, is preferably adapted to independently control the movements of said slide 4, said articulated arm 5 and said robotic apparatus 6.

Said control system 32 is, therefore, electronically connected to the various motors, actuators and/or systems (42, 53, 73) comprised in handler 3 according to the present invention. Said control system 32 is preferably adapted to control the whole handler 3 according to the present invention.

Preferably, said control system 32 is electronically connected to a control unit 10 comprised in drilling rig 1, for the purpose of using handler 3 as required during the different operating phases of the drilling rig.

In a preferred, but non-limiting, embodiment of said handler 3 according to the present invention, said handling head 7 comprises at least one gripper 72.

Said gripper 72 is adapted to seize, hold and appropriately release different types of drilling elements "P". Said gripper 72 is preferably handled by means of a suitable handling device 73. Preferably, such handling device 73 handles grippers 72 under control of said control system 32.

In one possible embodiment of handler 3 according to the present invention, said guides system 41 of said slide is adapted to slide along rails 121 comprised on mast 12. For example, said rails are located in the front part, between the lateral faces of mast 12. Such rails 121 allow slide 4 to slide along the entire longitudinal extension of mast 12. Preferably, said rails are parallel to the guides that allow moving top drive 15 comprised in drilling rig 1.

Said lifting system 42 of said slide 4 comprises a system of pulleys whereon a cable can slide, appropriately moved by a draw-works. Said guide system 41 and said lifting system 42 being arranged on a structure 40 of slide 4. Said structure 40 is so configured as to cause the handler to protrude relative to the position in which guides system 41 is located, so as to not interfere with the devices already comprised in drilling rig 1, such as, for example, top drive 15.

In one possible exemplary, but non-limiting, embodiment, said articulated arm 5 comprises actuators 53, e.g. electric and/or hydraulic ones. Said actuators 53 are preferably electronically connected to said control system 32 of handler 3.

In a preferred embodiment, said articulated arm 5 comprises a first portion 51 and a second portion 52. Said first portion 51, said second portion 52 and said actuators are appropriately interconnected to allow robotic apparatus 6 to be moved along said axis "X". The movement of said robotic apparatus 6 effected through said articulated arm 5 allows the same robotic apparatus 6 to assume at least two operating configurations. In the preferred embodiment, in at least both of these operating configurations articulated arm 5 keeps said second end of articulated arm 5 at the same height along the vertical axis. Preferably, said articulated arm 5 always keeps said second end of articulated arm 5 at the same height along the vertical axis.

In a preferred, but non-limiting, embodiment, said articulated arm 5 is an articulated arm with only one degree of freedom, wherein said first portion 51 and said second portion 52 are connected through a connection element adapted to allow articulated arm 5 to move in such a way that its second end will always remain at a constant height along vertical axis "Z", independently of the relative position of the two portions (51, 52) of articulated arm 5 itself.

In a preferred, but non-limiting, embodiment, said robotic apparatus 6 comprises a first portion and a second portion. Preferably, said first portion is connected to articulated arm 5, in particular to the second end, more preferably to said second portion 52, of articulated arm 5.

Said first portion comprises, in turn, a fixed element, adapted to be fixed to articulated arm 5, and a mobile element. The movement of said mobile element is controlled by the third electric motor 62C, so as to allow handling head 7 to rotate about a vertical axis. Preferably, said third electric motor 62C is adapted to rotate said handling head 7 by at least 360°.

Said second portion is connected to the first portion, and in particular to said mobile element of the first portion, through a mechanism that can be actuated by means of the first electric motor 62A in order to cause said handling head 7 to rotate about the first horizontal axis.

Said second portion preferably comprises a fork structure.

To the end of the second portion, corresponding to the second end of robotic apparatus 6, said handling head 7 is connected through a mechanism that can be actuated by means of the second electric motor 62B, which is adapted to cause said handling head 7 to rotate about a second horizontal axis.

Preferably, said first portion, said second portion and handling head 7 may comprise abutment elements adapted to define a mechanical stop for the relative movement between the parts.

Preferably, said gripper 72 of handling head 7 is handled by means of a suitable handling device 73. Said handling device 73 is adapted to appropriately move said grippers 72. Preferably, said gripper 72 comprises beaks adapted to turn about parallel axes, so as to make handling easier and/or to allow gripping different types of drilling elements "P". Said beaks can be moved by means of said handling device 73.

Said multifunction handler 3 is particularly adapted for being included in an assembly, particularly in a handling system. Said handling system is particularly adapted for handling, and in particular moving, drilling pipes "P". Said handling system is particularly suitable for being included in a drilling rig 1, particularly in drilling rigs 1 in the absence of human operators at least on a drill floor 13 and/or on a fingerboard 14 of the drilling rig 1.

Said handling system comprises, in addition to handler 3, a robotized arm 8. Said robotized arm 8 is adapted to slide along a guide 85. Said guide is arranged on said drill floor 13.

In a preferred embodiment of the handling system according to the present invention, said robotized arm 8 is adapted to seize, hold and appropriately release a first end of at least one drilling element "P" or of a series "S" of drilling elements. Preferably, said multifunction handler 3 is adapted to seize, hold and appropriately release a second end of the same at least one drilling element "P" or of the same series "S" of drilling elements.

Preferably, the handling system according to the present invention comprises a control unit 10. Said control unit 10 is adapted to at least control the relative movement of said handler 3 and said robotized arm 8. In particular, said control unit 10 is adapted to at least control the movement of the handling system in such a way as to obtain co-ordinated movements between at least said handler 3 and said robotized arm 8. In a preferred embodiment, said control unit 10 is comprised in drilling rig 1.

In one possible embodiment of the handling system according to the present invention, said guide 85 extends on drill floor 13. Said guide, e.g. a pair of rails, comprises a first end proximal to both main well "H", comprised in drill floor 13, and mast 12, and a second end in a remote position relative to mast 12 of drilling rig 1. Said robotized arm 8 is adapted to position itself in proximity to said first end of guide 85 in order to move drilling elements "P" away from and towards a well (H, M). Said robotized arm 8 is adapted to position itself in proximity to said second end of guide 85 in order to reduce the hindrance that it may cause during the execution of procedures pertaining to drilling rig 1. In addition, such a robotized arm 8 has compact dimensions, thus taking up less room on drill floor 13.

Said handler 3 and/or the handling system according to the present invention are particularly suitable for being comprised in a drilling rig 1.

Drilling rig 1 according to the present invention comprises a substructure 11 adapted to be placed on a ground "G" where drilling will take place.

Said drilling rig 1 according to the present invention further comprises a mast 12, which extends along a vertical axis parallel to said vertical axis "Z", along which axis the longitudinal extension of mast 12 is defined. The same drilling rig 1 comprises a drill floor 13, placed at a predefined height from ground "G", on top of substructure 11. From said drill floor 13, said mast 12 extends.

Drilling rig 1 further comprises a top drive 15, which is adapted to slide along said mast 12.

Mast 12 comprises, at a predefined height from drill floor 13, a fingerboard 14.

Said fingerboard 14 can house a plurality of drilling elements "P". Said fingerboard 14 is adapted to conveniently group said drilling elements "P" together.

Drilling rig 1 according to the present invention further comprises a lifting device or catwalk 16. Said catwalk 16 is adapted to move drilling elements "P" from ground "G" to drill floor 13, and vice versa.

Drilling rig 1 according to the present invention comprises at least one handler 3 and/or one handling system according to the present invention.

Drilling rig 1 according to the present invention advantageously comprises highly automated systems and circuits. The high level of automation of drilling rig 1 according to the present invention allows reducing the number of human operators working on the rig, and in particular on drill floor 13 and/or on fingerboard 14. Said highly automated systems and circuits are, for example, continuous circulation systems and systems for connecting the rig to drill pipes "P" during the steps of adding or removing the drill pipes.

Multifunction handler 3 according to the present invention is particularly suitable for implementing a method of assembling drilling elements "P", e.g. for creating and/or disassembling a series of drilling elements.

One aspect of the present invention relates to a method of assembling drilling elements "P" for creating a series "S" of drilling elements "P".

The method of assembling according to the present invention comprises the following steps, preferably to be carried out in succession:

a) seizing a drilling element "P", located on a drill floor 13, by means of said catwalk 16;

b) lifting drilling element "P" relative to a vertical axis "Z";

c) positioning drilling element "P" in a vertical position relative to said drill floor 13;

d) moving said drilling element "P" towards a mouse hole "M";

e) inserting said drilling element "P" into said mouse hole "M" and holding it therein;

f) repeating steps a) to d) in order to handle another drilling element "P";

g) bringing drilling elements "P" near each other and tightening them together;

h) inserting the assembled drilling elements "P" into said mouse hole "M" and holding them therein;

i) repeating steps f) to h) in order to assemble another drilling element "P".

This sequence of steps allows creating a series "S" of drilling elements "P" comprising at least three drilling elements "P", which are preferably equal. In fact, steps f) to i) can be repeated in order to connect the desired number of drilling elements "P".

By executing the above-described steps of the present method in the reverse order, it is possible to disassemble a plurality of drilling elements "P", e.g. a series "S".

The steps of the present method according to the present invention are carried out by means of a handler 3 according to the present invention.

Figure 6B:
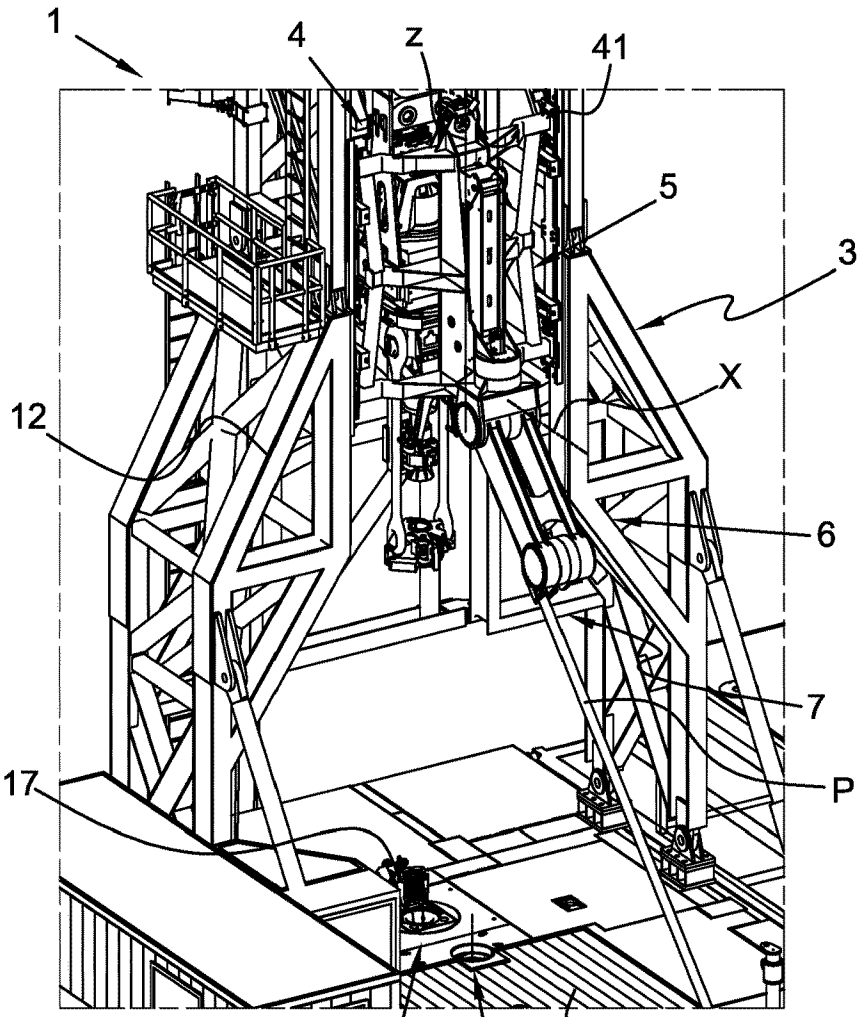
FIGS. 6A-6D show axonometric views of the handler during a sub-procedure for lifting the drilling elements comprised in a method of assembling according to the present invention; in particular.
Figure 6A:
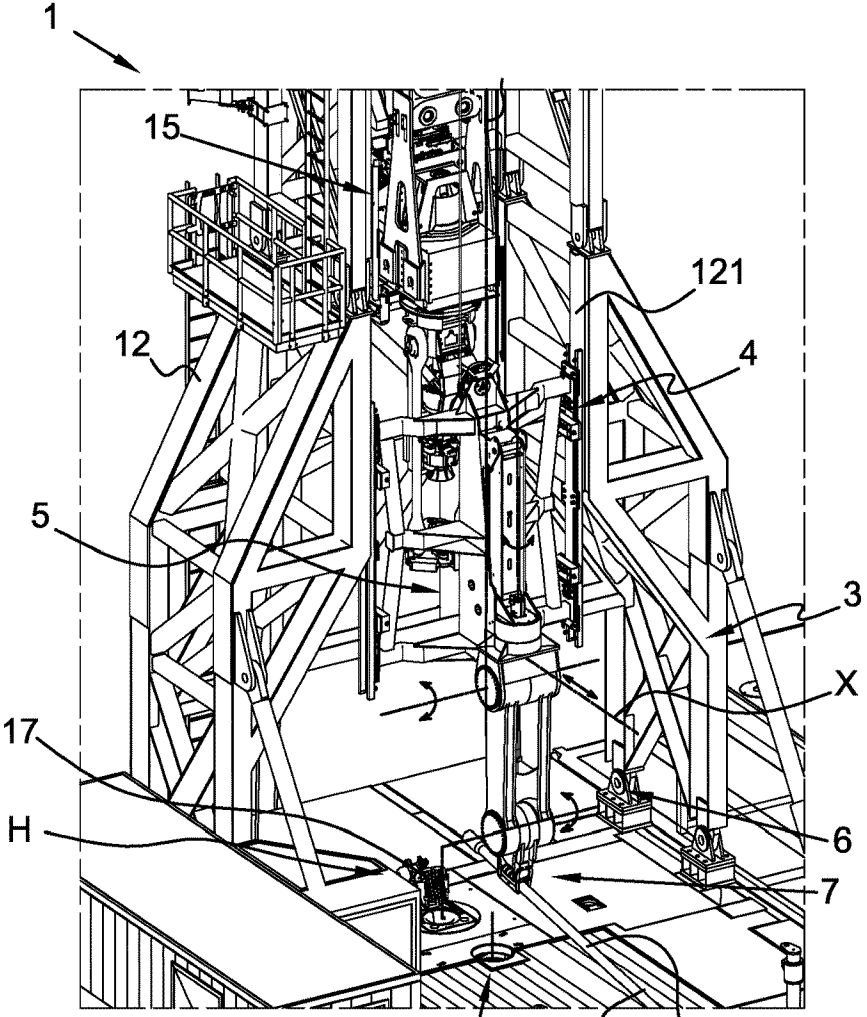

The step of seizing a drilling element "P", carried out by handler 3, allows seizing drilling element "P", preferably at one end of drilling element "P" itself, in a firm and safe manner. By way of example, FIG. 6A shows handler 3 seizing one end of drilling element "P" that has been brought near drill floor 13 by a catwalk 16. This step allows for automatic seizing of drilling element "P" that has arrived on drill floor 13, without requiring any further intervention by human operators.

The step of lifting drilling element "P" relative to a vertical axis "Z", carried out by handler 3 according to the present invention, allows drilling element "P" to be lifted safely while reducing the load on handler 3 itself. FIG. 6B shows handler 3 lifting drilling element "P" seized as shown in FIG. 6A, by making a movement that reduces as much as possible the loads acting upon handler 3, and particularly upon handling head 7.

Figure 6D:
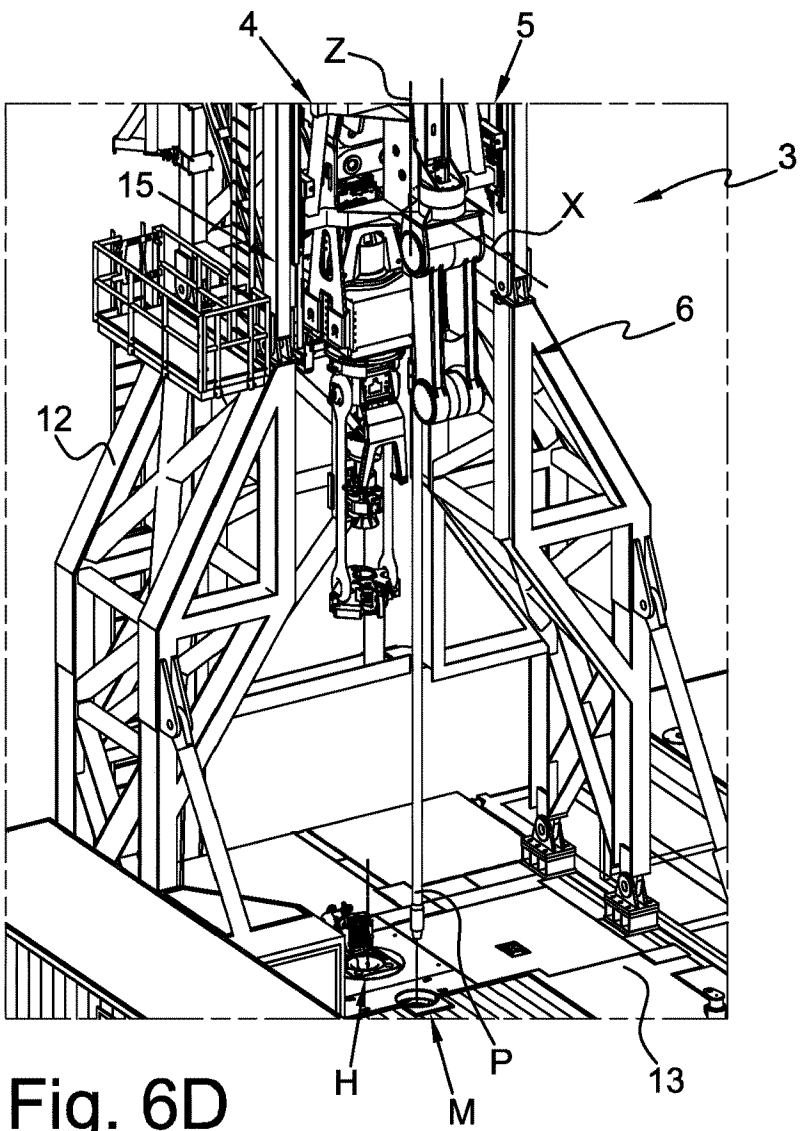
Figure 6C:
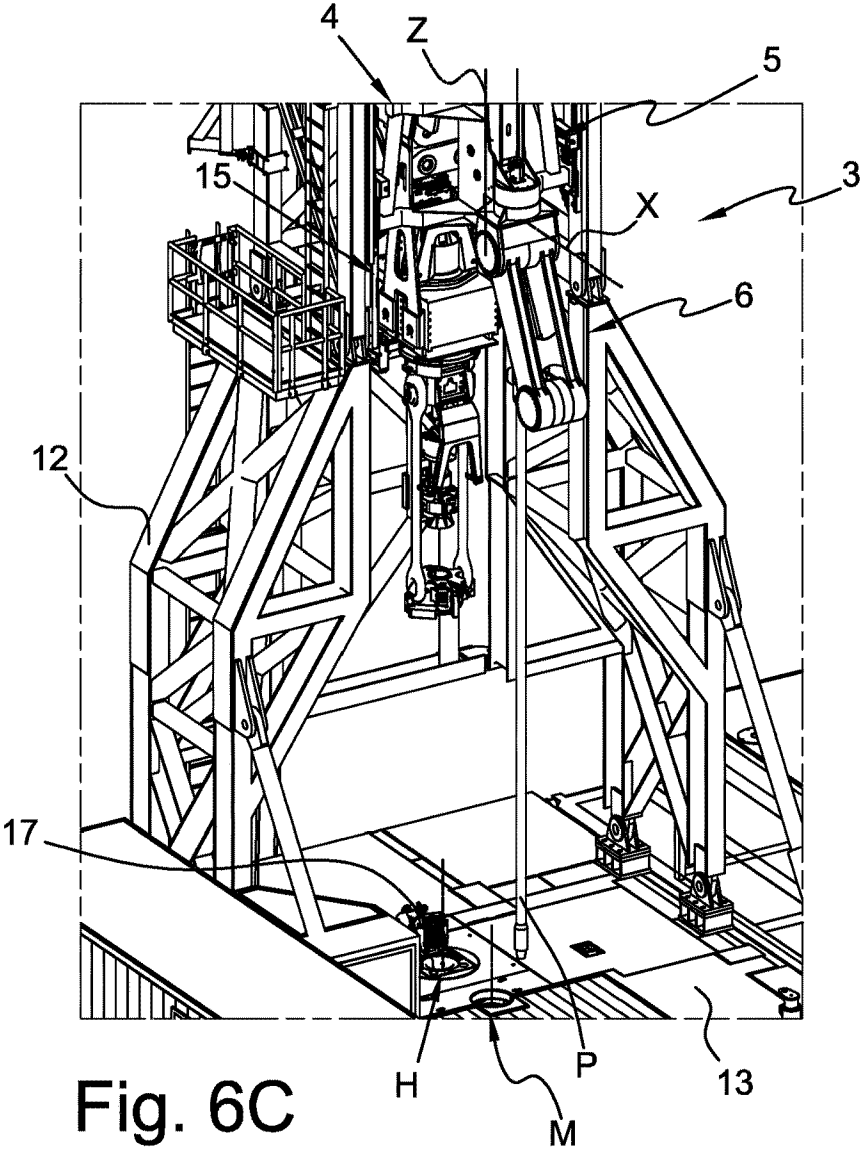

The step of positioning drilling element "P" in a vertical position, by means of handler 3, is carried out in such a way as to reduce as much as possible the risk of triggering any sussultatory or vibratory movements of drilling element "P" itself. Such a solution allows reducing the risk of accidents on drill floor 13. FIG. 6C shows handler 3 placing the drilling element in a vertical position for the purpose of allowing it to be easily positioned into the appropriate well, e.g. the main well or well centre "H", or a secondary well or mouse hole "M".

During the step of moving said drilling element "P" towards a mouse hole "M", the same handler 3 is used in order to easily, safely and quickly position drilling element "P" over mouse hole "M". FIG. 6D shows handler 3 bringing drilling element "P", arranged vertically as shown in FIG. 6C, towards the secondary well or mouse hole "M".

Figure 7B:
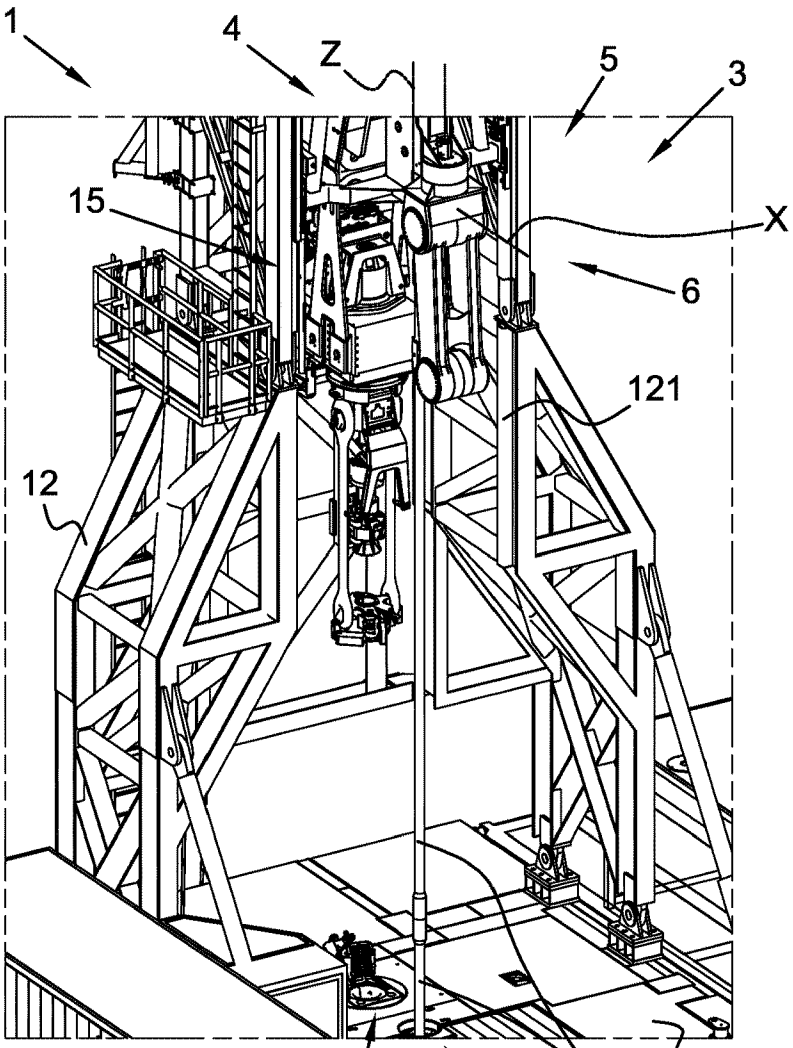
FIGS. 7A-7E show different axonometric views of the handler during a sub-procedure for connecting the drilling elements comprised in the method of assembling; in particular.
Figure 7A:
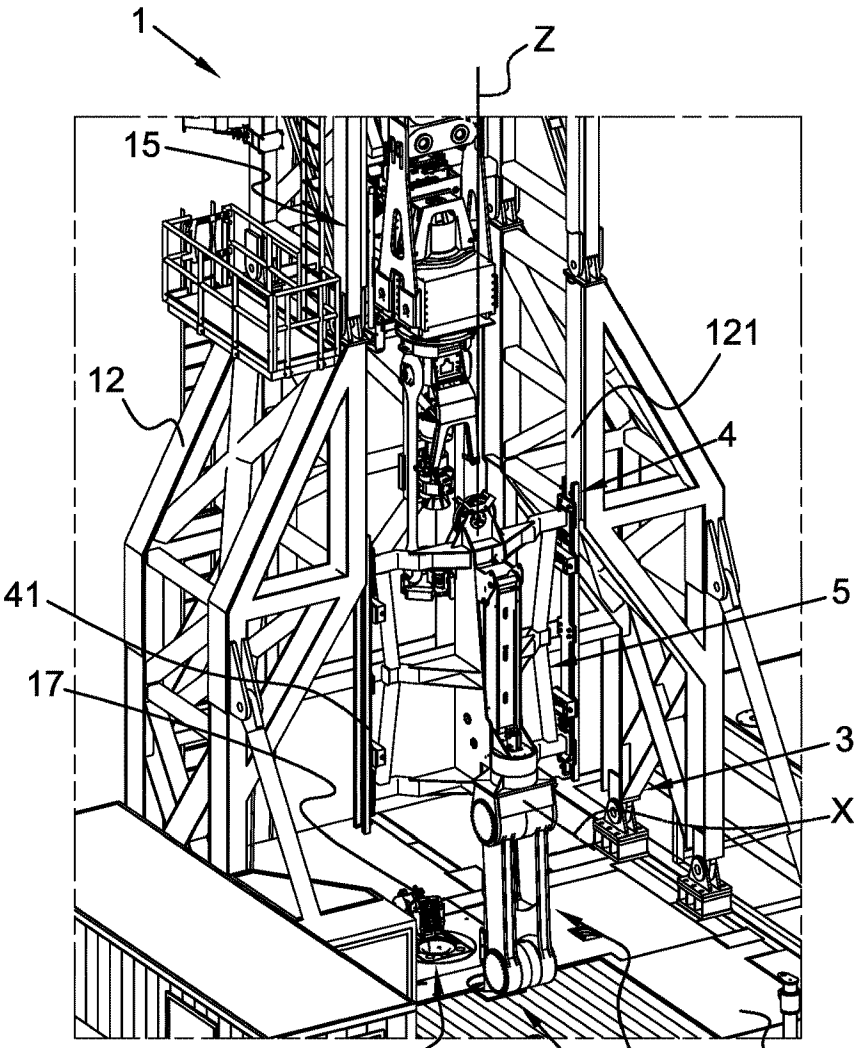

During the step of inserting said drilling element "P" into said mouse hole "M" and holding it therein, drilling element "P", once it has been inserted into said mouse hole "M" by handler 3, is held by at least a retaining device already included in drilling rig 1 so that it remains at a predefined height within mouse hole "M". FIG. 7A shows a first drilling element "P" being positioned into the mouse hole "M" by said handler 3.

Preferably, drilling element "P" is held by means of a clamp 17 arranged inside the same mouse hole "M", which prevents drilling element "P" from falling down within mouse hole "M".

Once the first drilling element "P" has been placed into mouse hole "M", handler 3 will release drilling element "P" and carry out the same steps already described, and in particular steps a) to d) of the method according to the present invention, in order to handle another drilling element "P", in particular a second drilling element "P".

Once the second drilling element "P" has been arranged vertically and aligned with mouse hole "M", the step of bringing drilling elements "P" near each other and tightening them together is carried out. During this step, a connection system, e.g. a power tong comprised on drill floor 13, is used in order to tighten the two drilling elements "P" together. In this way, the tightening torque necessary to ensure proper tightening is applied to both drilling elements "P". FIG. 7B shows handler 3 holding a second drilling element "P" to be coupled and tightened to the first drilling element "P" placed in mouse hole "M". Tightening is effected by means of a power tong.

Figure 7C:
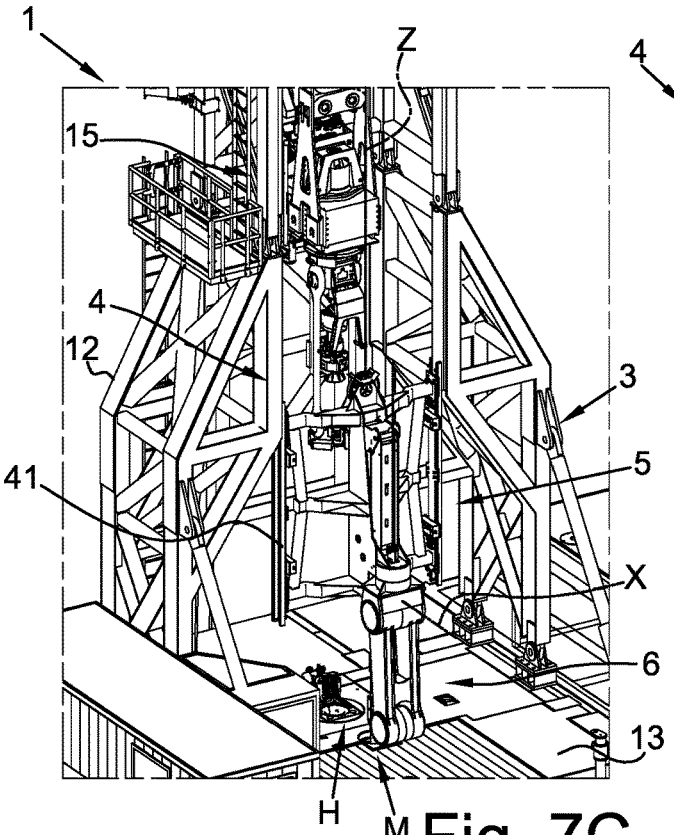

When the step of bringing drilling elements "P" near each other is complete, the step of inserting said assembled drilling elements "P" into said mouse hole "M" and holding them therein is carried out. During this step, the assembly of drilling elements "P" is inserted, by means of handler 3, into mouse hole "M" down to an adequate depth. When the assembly has arrived at the optimal depth, the assembly of drilling elements "P" is held by clamp 17, arranged within the same mouse hole "M", to prevent the same assembly of drilling elements "P" from falling down within mouse hole "M". In one possible embodiment, the system holding drilling elements "P" in mouse hole "M" is the same system used for tightening drilling elements "P" together. FIG. 7C shows handler 3 positioning the assembly consisting of the two drilling elements "P" into mouse hole "M".

Once the assembly of drilling elements "P" has been placed into mouse hole "M", handler 3 will release the assembly and carry out the same steps already described, and in particular step f) to step h) of the method according to the present invention, in order to handle another drilling element "P", in particular a third drilling element "P". FIG. 7D shows the positioning of a third drilling element "P" to be connected and tightened to the assembly of the first and second drilling elements "P" placed in mouse hole "M". The handling of the third drilling element "P" is effected by means of handler 3 in the same way as already described for the first and second drilling elements "P"; furthermore, the same third drilling element "P" is suitably tightened to the assembly of the first and second drilling elements "P" placed in mouse hole "M".

This sequence of steps allows assembling together at least three drilling elements "P" for the purpose of obtaining a series "S" of at least three drilling elements "P".

The above-described method can be repeated, in particular by repeating steps i), in order to create a series of drilling elements comprising more than three drilling elements "P".

The number of drilling elements "P" connected together to form series "S" will depend on the dimensions of drilling elements "P" themselves and on the characteristics of drilling rig 1 in which such series "S" will have to be used.

Figure 7E:
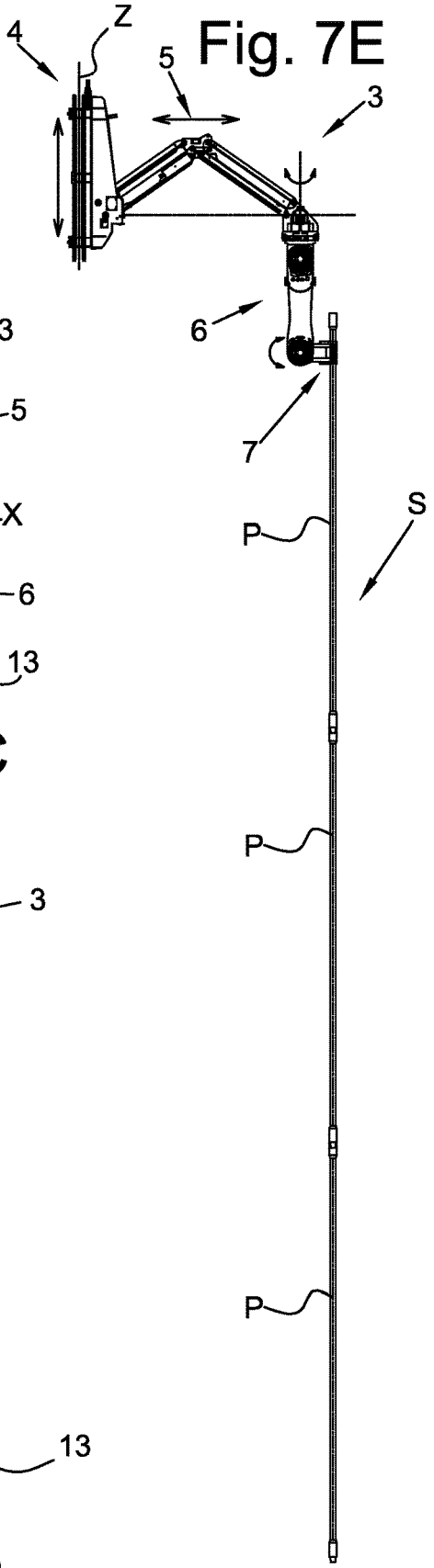
Figure 7D:
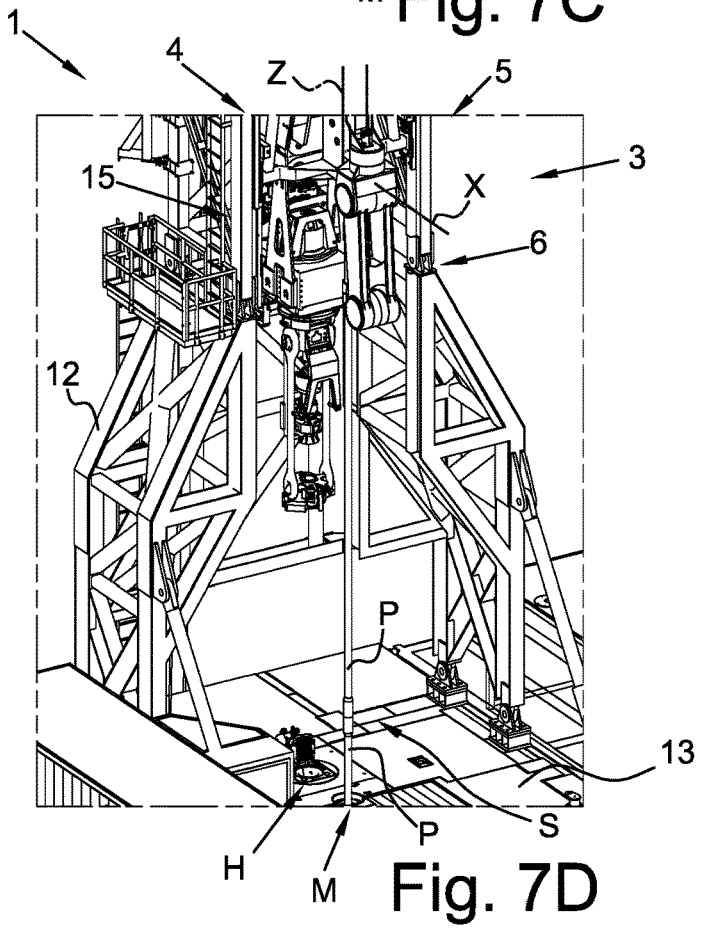

FIG. 7E shows a side view of handler 3 supporting an exemplary series "S", made up of three interconnected drilling elements "P".

Multifunction handler 3 according to the present invention is particularly suitable for implementing a method of moving drilling elements "P" from a well, e.g. a secondary well or mouse hole "M", towards a fingerboard 14 of a drilling rig 1.

The method of moving according to the present invention comprises the following steps, preferably to be carried out in succession:

- seizing, by means of a handling head 7, a drilling element "P" retained by at least one retaining element, e.g. a clamp 17, at said well (M, H);
- moving said drilling element "P" away, in particular from the axis of said well (M, H) and towards an area where it is less of a hindrance;
- reversing the orientation of said handling head 7,
- by rotating at least a part of handler 3 about at least one axis, preferably a vertical axis;
- moving said drilling element "P" towards a suitable housing 142 comprised in fingerboard 14;
- lowering said drilling element "P";
- releasing said drilling element "P" into appropriate housing 142.

This sequence of steps allows moving a plurality of drilling elements "P", preferably in the form of a series "S" of drilling elements "P", comprising, for example, three drilling elements "P", which are preferably equal.

The reversal of the steps described in the present method allows moving at least one series "S" of drilling elements "P" from fingerboard 14 towards at least one well (H, M).

The steps of the present method according to the present invention are carried out by means of a handler 3 according to the present invention.

The step of seizing a drilling element "P" by means of a handling head 7 is preferably carried out in order to seize a series "S" of drilling elements "P". Depending on the type of well, e.g. the main well "H" or mouse hole "M", drilling element "P" is retained by one or more independent clamps.

Said clamps may be directly comprised in the well and/or associated with a device interacting with said well, such as the top drive 15.

Figure 8A:
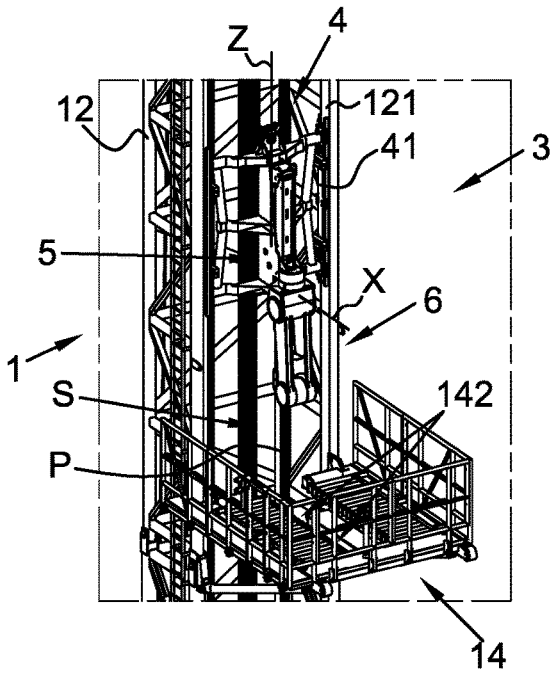
FIGS. 8A-8D show, in axonometric views, the handling of a stand of drilling elements from a well to a fingerboard; in particular.

In a preferred, but non-limiting, embodiment like the one shown by way of example in FIG. 8A, handler 3 lifts a plurality of drilling elements "P", preferably a series "S", so as to bring one end thereof near a fingerboard 14 comprised in drilling rig 1. Said fingerboard 14 is located at a predefined height of mast 12 relative to drill floor 13. The same fingerboard is designed to include a plurality of housings, preferably arranged in a rack-like fashion, starting at a minimum distance from mast 12.

In general, the lifting of series "S", effected by means of handler 3, occurs in alignment with the axis of mouse hole "M".

Figure 8B:
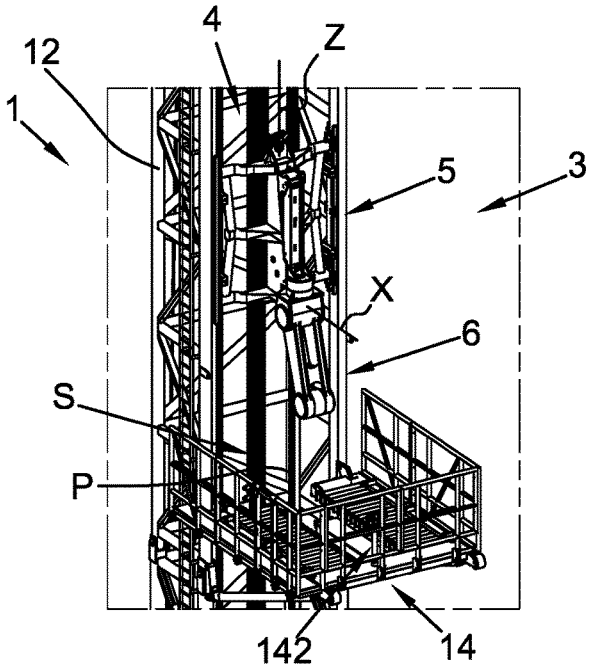

In the preferred embodiment, during the step of moving said drilling element "P" away from the axis of said well (M, H) and towards an area where it is less of a hindrance, said series "S" is moved along axis "X" by means of multifunction handler 3. Preferably, said less hindering area is an area in front of mast 12, between mast 12 and the area including housing 142 of fingerboard 12. Due to the characteristics of handler 3 according to the present invention, said less hindering area can be small. In the exemplary embodiment of FIG. 8B, by offsetting the series "S" relative to the axis of mouse hole "M", it is possible to position series "S" in an area where it is less of a hindrance.

Subsequently, the method includes the step of reversing the orientation of said handling head 7 by rotating at least a part of handler 3.

In the preferred embodiment, said part of handler 3 is rotated about an axis parallel to said vertical axis "Z". In this manner, handler 3 can arrange a series "S" in the optimal position for inserting it into fingerboard 14, even if the available room is small.

Figure 8C:
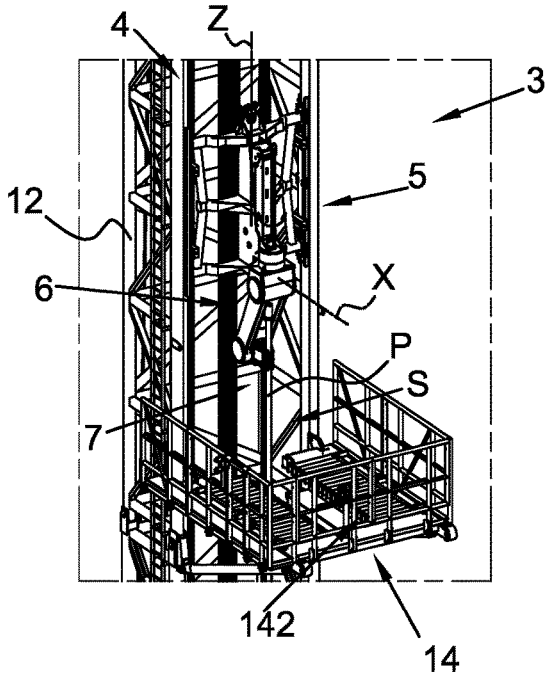

In the exemplary, but non-limiting, embodiment, as shown in FIG. 8C, the reversal of the orientation of handling head 7 of handler 3 is such as to place handler 3 in the best configuration to ensure an easy positioning of drilling element "P" inside fingerboard 14. This step allows handler 3 to be immediately used for other types of handling of drilling elements "P", according to the requirements of drilling rig 1.

Subsequently, the method includes a step of moving said drilling element "P" towards a suitable housing 142 comprised in fingerboard 14.

During this step it is necessary to move handler 3 in such a way as to reach the corresponding suitable housing 142 comprised in fingerboard 14. In this step it is possible to change the distance along said axis "X" relative to mast 12 by means of said articulated arm 5, as well as to rotate about an axis parallel to said axis "Z" and/or adapt the position of handling head 7 by means of said robotic apparatus 6. In particular, it is possible to suitably activate one or more electric motors 62 comprised in robotic apparatus 6 in order to reach any housing 142 of fingerboard 14.

Figure 8D:
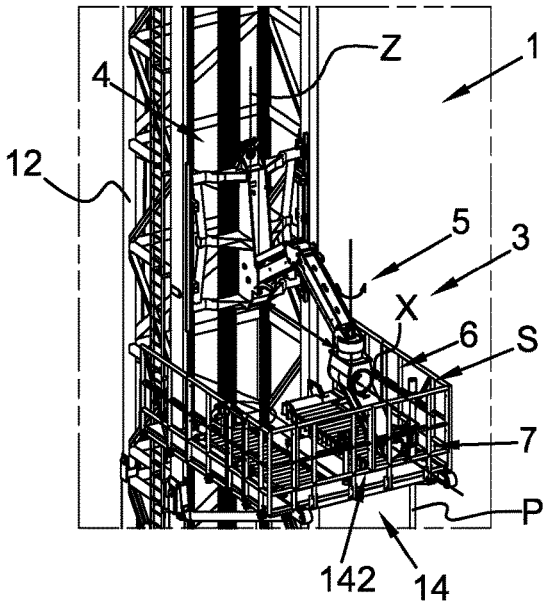

In the exemplary, but non-limiting, embodiment, as shown in FIG. 8D, series "S" of drilling elements "P" is moved by said handler 3 to an appropriate housing 142 comprised in fingerboard 14.

Subsequently, the method includes the step of lowering said drilling element "P". In this step it is possible, through handler 3, to put drilling element "P" into the appropriate position within housing 142, so that it can be suitably racked and stored for future use by a drilling rig 1.

The method according to the present invention then includes the step of releasing said drilling element "P" into appropriate housing 142. Preferably, series "S" of drilling elements, suitably placed in housing 142, is released by handler 3, which can then be used for carrying out other activities within drilling rig 1. Drilling element "P" placed in housing 142 can then be picked up again, e.g. by the same handler 3, in order to be used in the drilling procedure to be carried out by drilling rig 1.

Furthermore, multifunction handler 3 and/or the handling system according to the present invention are particularly adapted for implementing a method of moving drilling elements "P" from a fingerboard 14 towards a well (M, H), preferably a main well "H" of a drilling rig 1.

One aspect of the present invention relates to a method of moving drilling elements "P" from a fingerboard 14 towards a well (M, H) of a drilling rig 1.

The method of moving according to the present invention comprises the following steps, preferably to be carried out in succession:

i. seizing, through a handling head 7, a drilling element "P" stored in a suitable housing 142 comprised in fingerboard 14.

ii. lifting said at least one drilling element "P";

iii. moving said drilling element "P" towards an area where it is less of a hindrance to the rest of drilling rig 1;

iv. reversing the orientation of said handling head 7, by rotating at least a part of handler 3 about at least one axis;

v. moving said drilling element "P" and aligning it with the axis of said well (M, H);

vi. releasing drilling element "P", which is retained by at least one retaining device, e.g. a clamp 17, at said well (M, H).

This sequence of steps allows moving a plurality of drilling elements "P", preferably in the form of a series "S" of drilling elements "P", comprising, for example, three drilling elements "P".

The reversal of the steps described in the present method allows moving at least one series "S" from at least one well (H, M) towards fingerboard 14.

The steps of the present method according to the present invention are carried out by means of a handler 3 according to the present invention.

The step of seizing, by means of a handling head 7, said drilling element "P" placed in a suitable housing 142 is carried out by means of handler 3, which, thanks to its degrees of freedom, can reach any drilling element "P" housed in any housing 142 of fingerboard 14, and can seize it by means of said handling head 7.

Subsequently, the step of lifting said drilling element "P" is carried out. Said handler 3, after having seized drilling element "P", can lift it, e.g. by making a movement along said axis "Z".

Figure 9B:
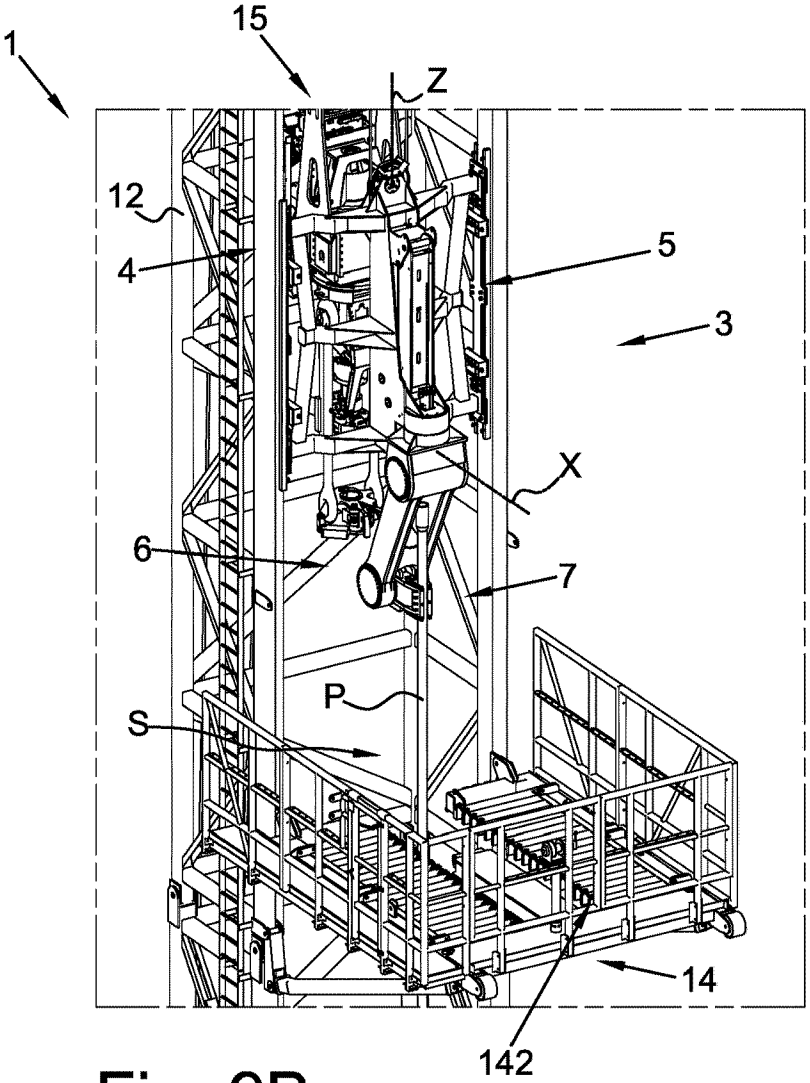
Figure 9A:
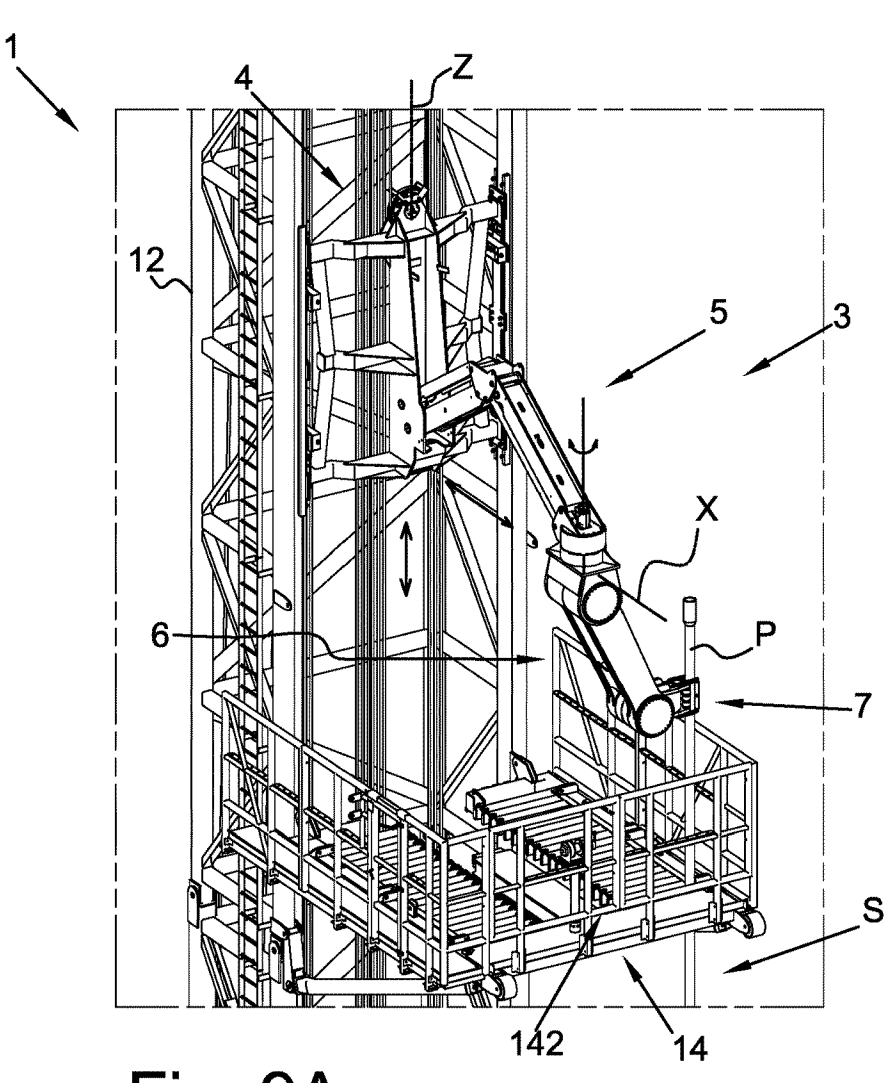

In the exemplary, but non-limiting, embodiment shown in FIG. 9A, series "S" of drilling elements "P" located in housing 142 of fingerboard 14 is seized and lifted by handler 3. For example, the latter can seize and lift a drilling element as shown, by way of example, in FIG. 8D.

Subsequently, the method includes the step of moving said drilling element "P" towards an area where it is less of a hindrance to the rest of drilling rig 1. Preferably, said less hindering area is an area in front of mast 12, between mast 12 and the area where housings 142 of fingerboard 14 are located.

In the preferred embodiment, as shown by way of example in FIG. 9B, series "S" of drilling elements "P" is placed into a less hindering area by means of said handler 3. Thus, handler 3 moves drilling element "P" from housing 142 towards an area where further handling can occur as necessary.

Subsequently, the method includes the step of reversing the orientation of said handling head 7, by rotating at least a part of handler 3 about an axis, preferably a vertical axis. In this manner it is possible, without taking up much space, to prearrange handler 3 into the best conditions for positioning the same series "S" of drilling elements "P" in view of subsequent handling steps.

In the exemplary, but non-limiting, embodiment, as shown in FIG. 9C, the reversal of the orientation of handling head 7 of handler 3 is such that handler 3 itself is put into the best configuration for moving drilling element "P" more easily towards the well (H; M).

For the purposes of the present description, the reversal of the orientation of said handling head 7, effected by rotating at least a part of handler 3 during the execution of any method of moving according to the present invention, can be achieved through a movement of more than one part of handler 3, even about more than one axis, depending on the conformation of handler 3 itself, e.g. through a combination of movements about horizontal axes.

In general, the method provides for executing, after the above steps, the step of moving said drilling element "P" to bring it into alignment with the axis of said well (M, H).

The movement of drilling element "P" by means of said handler 3, for bringing it into alignment with the axis of the well, preferably over well centre "H", allows drilling element "P" to be aligned with the axis of the well in which said drilling element "P" is required. In the exemplary, but non-limiting, embodiment, as shown in FIG. 9D, series "S" of drilling elements "P" is moved towards well centre "H", so that it can be clamped by a clamp comprised in top drive 15.

Subsequently, the method includes the step of releasing drilling element "P". During this step, handler 3 releases drilling element "P", which is already retained by at least one clamp (17, 15). In this manner, drilling element "P" is delivered from handler 3 to another device comprised in drilling rig 1, e.g. top drive 15, so that handler 3 can then be used for other functions within drilling rig 1.

In the exemplary, but non-limiting, embodiment, as shown in FIG. 9E, handler 3, after having released series "S" of drilling elements "P", which is supported by a clamp comprised in top drive 15, can be used for performing other functions, thus automating the drilling rig 1 according to the present invention.

Control unit 32 of handler 3, and more in general control unit 10 of the handling system and/or of drilling rig 1, are adapted to control the execution of at least a part of the methods according to the present invention, e.g. by cooperating with each other.

Figure 1A:
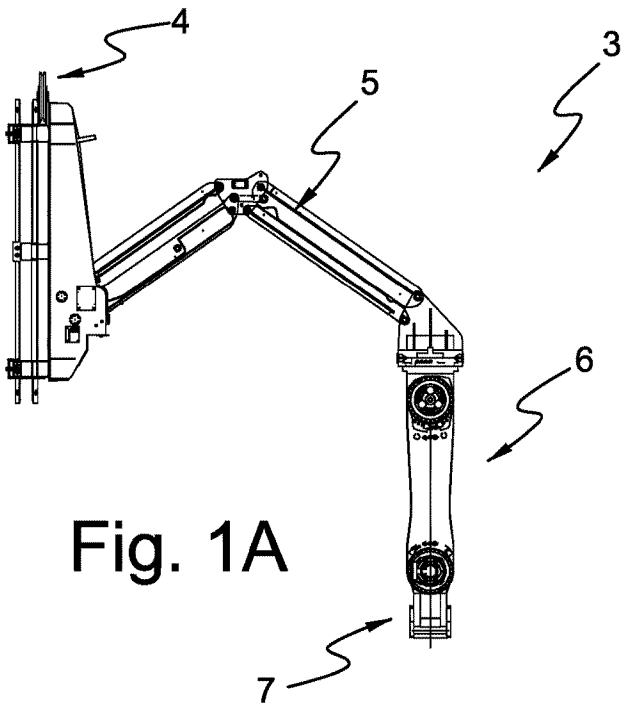
FIGS. 1A and 1B show one possible embodiment of the handler and control system according to the present invention; in particular.

With reference to FIG. 1A, there is shown a side view of handler 3 according to the present invention in one possible operating configuration. This figure allows understanding one possible exemplary, but non-limiting, embodiment of slide 4, of articulated arm 5, of robotic apparatus 6, and of handling head 7.

Figure 1B:
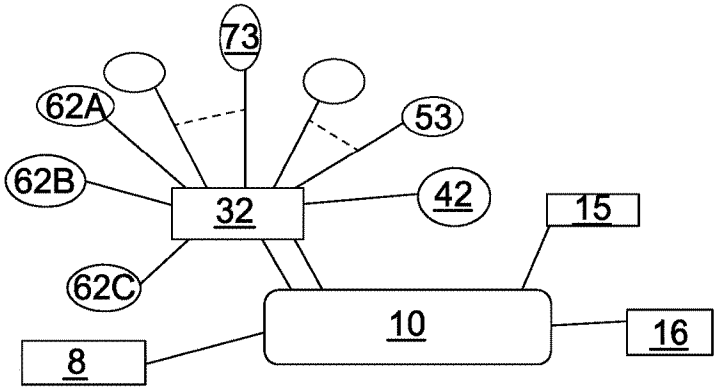

FIG. 1B schematically shows how control system 32 of handler 3 is electronically connected to the motors and/or actuators and/or sensors comprised in the handler itself to allow for optimal control thereof.

The same control system 32 is electronically connected to the control unit that controls the handling system and, more in general, the whole drilling rig 1.

FIG. 2 shows an overlay side view of handler 3 in different possible operating configurations, and in particular of robotic apparatus 6 according to one possible exemplary, but non-limiting, embodiment of handler 3. The figure also shows said slide 4, which comprises a guide system 41 and a lifting system 42, so that it can slide along a first axis "Z". Said guide system 41 and said lifting system 42 are provided on structure 40 of slide 4.

The drawing also shows said articulated arm 5, which comprises a first portion 51 and a second portion 52, appropriately connected to each other so as to allow robotic apparatus 6 to move along axis "X". Said first portion 51 is connected to said slide 4; whereas said second portion 52 is connected to said robotic apparatus 6.

In the drawing one can also see said robotic apparatus 6, comprising a plurality of electric motors 62, and in particular a first electric motor 62A, a second electric motor 62B and a third electric motor 62C, adapted to suitably move handling head 7, according to the various possible configurations shown in an overlay view in FIG. 2.

The drawing also shows one possible embodiment of handling head 7. Said handling head 7 being connected to the opposite end of the robotic apparatus 6 relative to the point of connection to said articulated arm 5.

From FIG. 2 one can understand the breadth of the margin of manoeuvre ensured by the several degrees of freedom of handler 3 according to the present invention. In fact, through slide 4 it is possible to obtain a first degree of freedom, by making a movement along said axis "Z". Through articulated arm 5 it is possible to obtain at least one additional degree of freedom, due to at least the movement along an axis "X", perpendicular to said axis "Z".

Moreover, through robotic apparatus 6 according to the present invention it is possible to add three further degrees of freedom provided by electric motors (62A, 62B, 62C), of which at least the third electric motor 62C allows for rotation about an axis parallel to said axis "Z", and the other electric motors (62A, 62B) can provide two additional degrees of freedom through a rotation, in particular through oscillatory movements about at least two axes, which are preferably horizontal and hence perpendicular to said vertical axis "Z".

Handling head 7 may comprise further degrees of freedom for the purpose of further increasing the number of functions of handler 3.

Figure 3C:
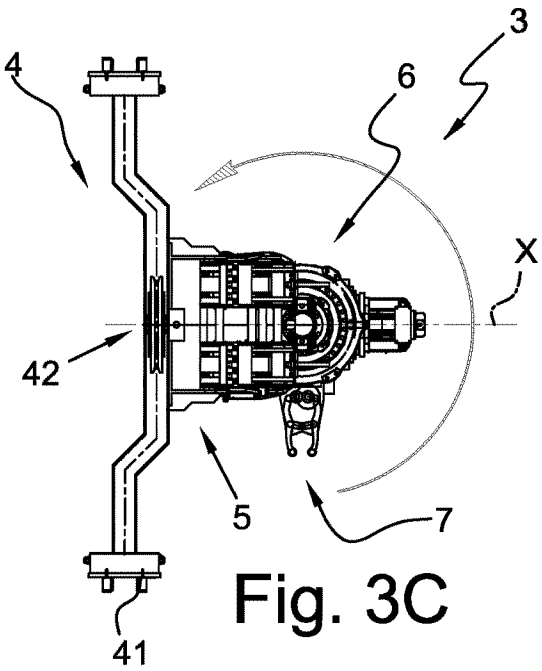
FIGS. 3A, 3B, 3C and 3D show a top view of the handler in different possible operating configurations; in particular.
Figure 3B:
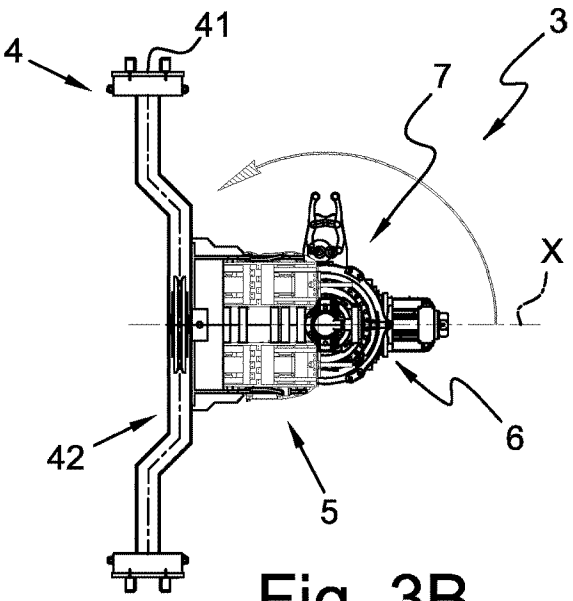
Figure 3A:
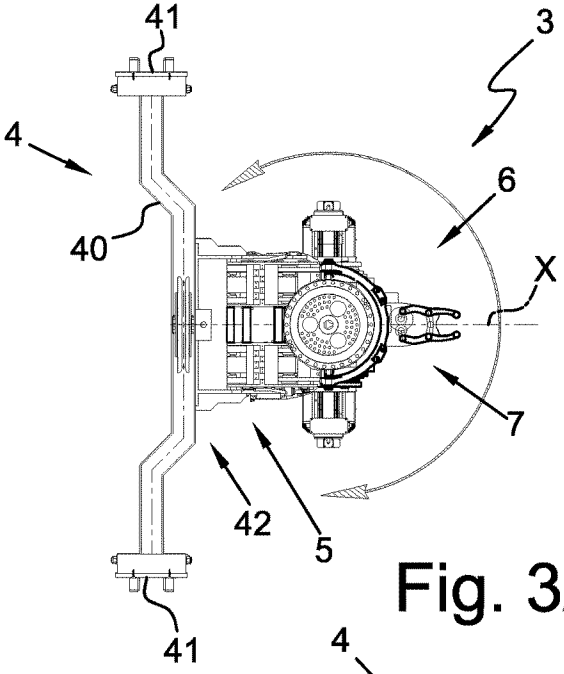

FIG. 3A shows handler 3 in a top view. Handler 3 is in a first configuration, wherein handling head 7 has been set into the illustrated arrangement by said robotic apparatus 6. From this figure one can understand the conformation of structure 40 of slide 4. Said handler is so shaped as to protrude along said axis "X" relative to the position of said guide system 41.

In the illustrated embodiment, articulated arm 5 is in the configuration in which it is least extended along said axis "X", thus assuming a compact configuration.

The preferred embodiment of handler 3 according to the present invention allows, through said robotic apparatus 6, at least said handling head 7 to rotate by at least 360° about an axis parallel to said axis "Z".

FIG. 3B shows handler 3 in a second configuration. This configuration of handler 3 is turned by at least 90 degrees about an axis parallel to said vertical axis "Z", in particular compared to said FIG. 3A.

FIG. 3C shows handler 3 in a third configuration, turned about an axis parallel to said axis "Z". For example, such rotation is, compared to said FIGS. 3A and 3B, a rotation by at least 270° compared to FIG. 3A and by at least 180° compared to FIG. 3B.

From the sequence of FIGS. 3A-3C it is possible to comprehend one possible embodiment of handler 3 according to the present invention, which allows handling head 7 to rotate by at least 360° about a vertical axis.

Figure 3D:
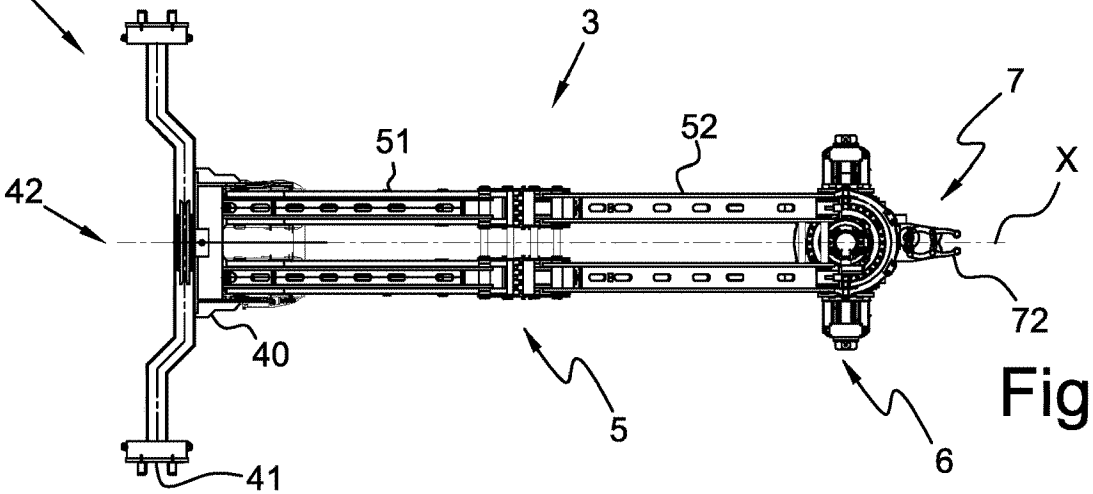

FIG. 3D shows a top view of handler 3 according to the present invention, wherein said articulated arm 5 has taken an extended configuration, compared to handler 3 illustrated in FIGS. 3A-3C. From this image it is possible to see the possible travel of handler 3 along said axis "X", due to at least said articulated arm 5. In this figure one can see the portions of articulated arm 5 that allow moving robotic apparatus 6 at least along said axis "X".

Figure 4A:
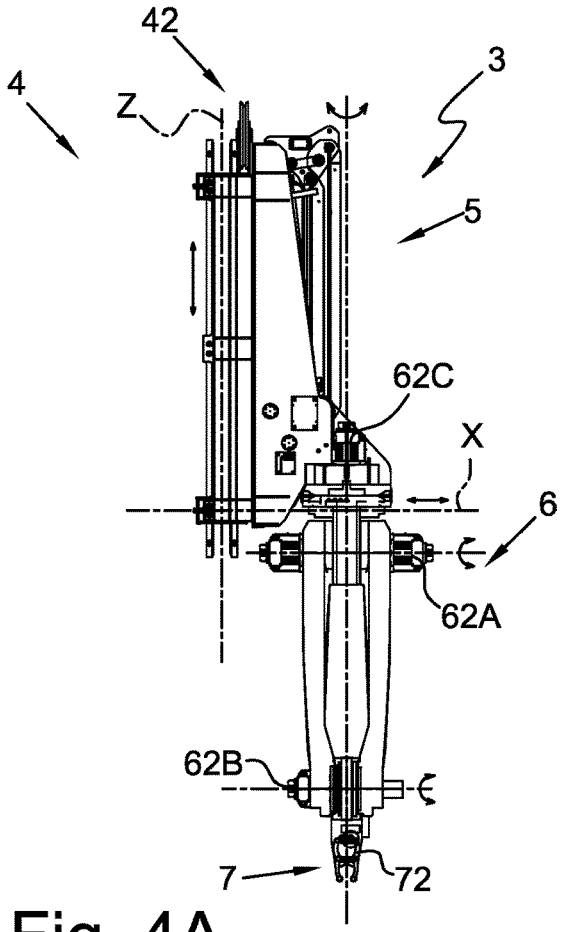
FIGS. 4A, 4B and 4C show a side view of the handler in different possible operating configurations; in particular.

FIG. 4A shows a side view of handler 3 in a first configuration. In this configuration, handling head 7 takes a particular arrangement following the movement effected by means of robotic apparatus 6.

Figure 4B:
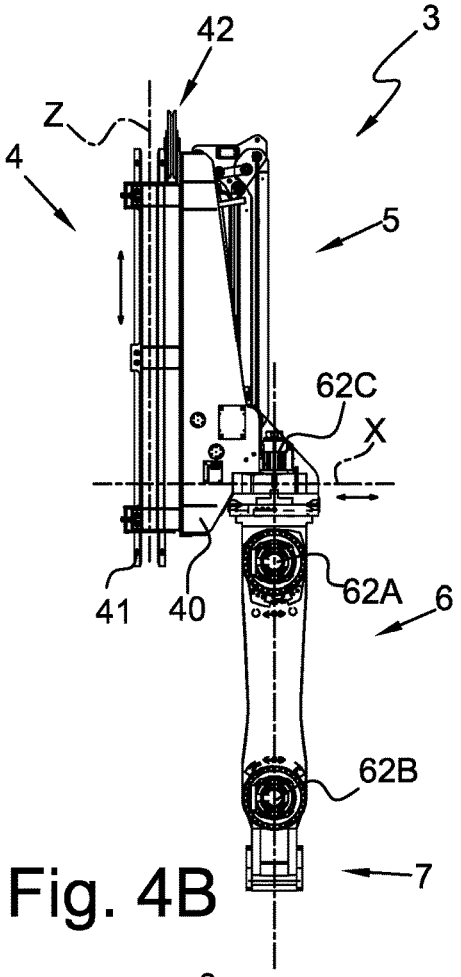

FIG. 4B shows a side view of handler 3 in a second configuration. This second configuration is rotated compared to the operating configuration shown in FIG. 4A. In particular, the second configuration of handler 3 is rotated about an axis parallel to the vertical axis, e.g. by 90°, by means of said third electric motor 62C.

From the sequence of FIGS. 4A and 4B it is possible to infer one possible embodiment of the robotic apparatus 6. Based on such figures, one can determine the conformation of the portions of robotic apparatus 6.

FIGS. 4A and 4B show articulated arm 5 in a retracted configuration, wherein the same articulated arm is suitably folded.

Figure 4C:
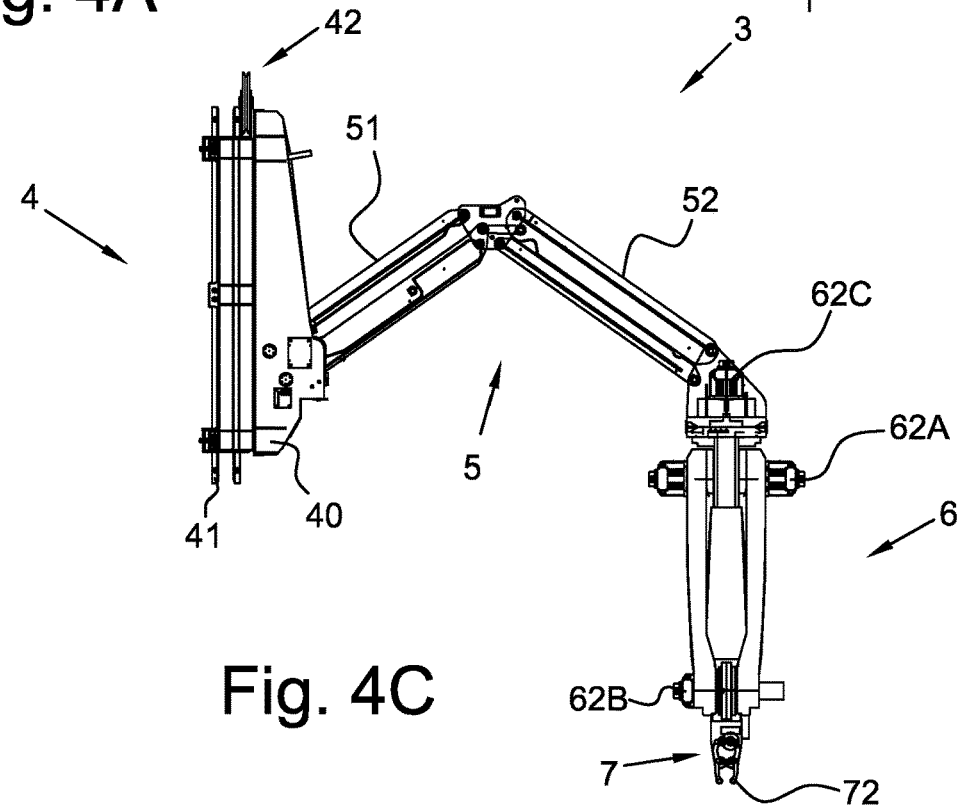

FIG. 4C shows the handler with said articulated arm 5 in an extended configuration, compared to said FIGS. 4A and 4B. In particular, FIG. 4C shows handler 3, and in particular handling head 7, in a configuration that is similar to that shown in FIG. 4A. As aforementioned, articulated arm 5 is shown in FIG. 4C in a possible extended configuration.

Figure 5A:
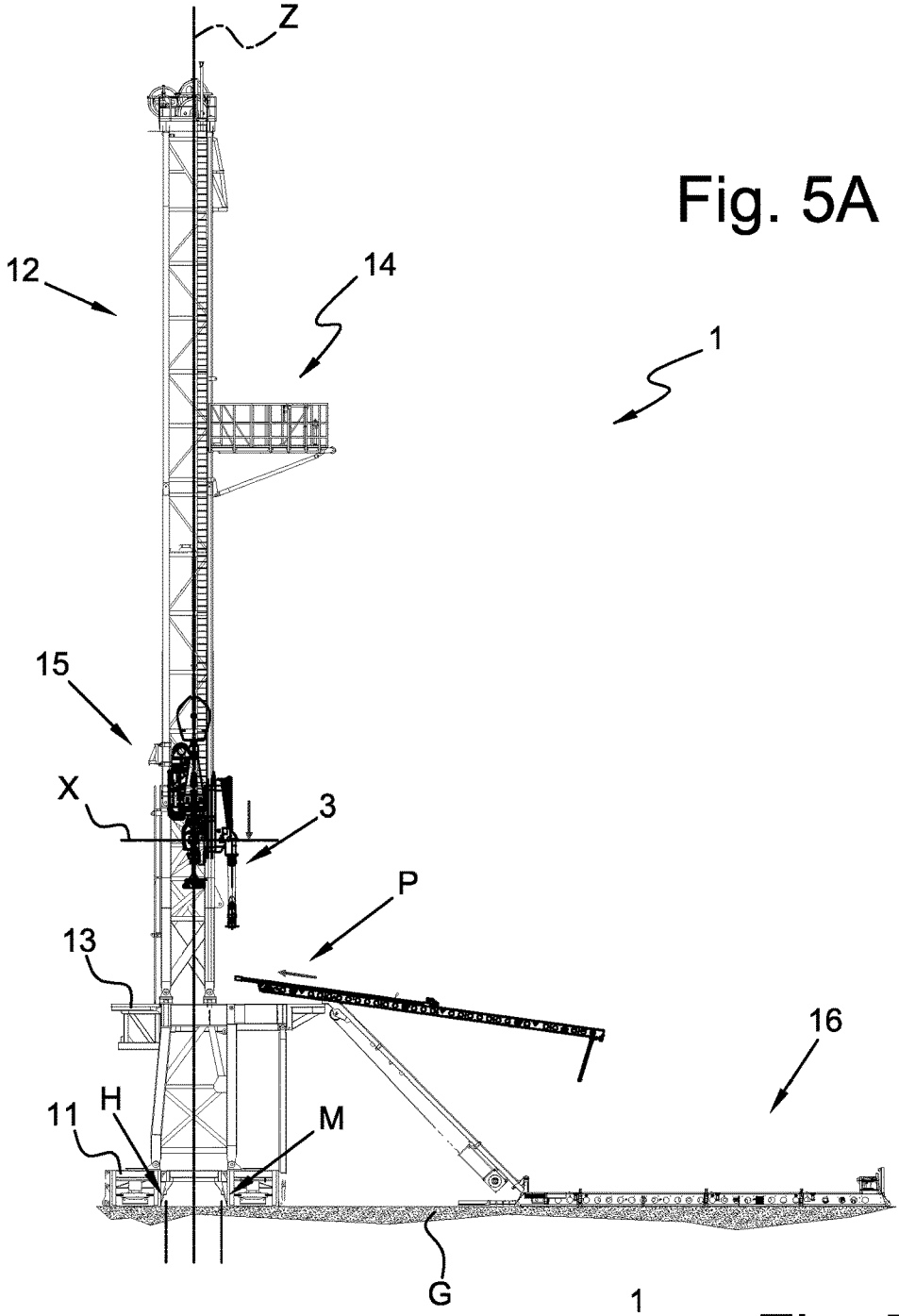
FIGS. 5A and 5B show two different views of a drilling rig according to the present invention; in particular.

FIG. 5A shows a side view of the drilling rig according to the present invention. This figure shows one possible embodiment of rig 1, which comprises a substructure 11 placed on a ground "G" where drilling will occur; a mast 12, which extends along said vertical axis "Z"; and a drill floor 13.

Said drill floor 13 is arranged at a predefined height from ground "G", on top of substructure 11. Said mast 12 is located over said substructure 11, starting from said drill floor 13. A top drive 15 is comprised in said mast 12, and can slide along said mast 12.

Said mast 12 comprises a fingerboard 14, in which a plurality of drilling elements "P" can be housed into suitable housings 142.

Said fingerboard 14 is located at a predefined height from drill floor 13 and is directly connected to the structure of mast 12.

Drilling rig 1, shown in FIG. 5A, further comprises a lifting device or catwalk 16. Said catwalk 16 is adapted to move drilling elements "P" from ground "G" to drill floor 13, and vice versa.

Drilling rig 1 according to the present invention comprises a handler 3 and/or a handling system according to the present invention.

Said catwalk 16 is located in the front part of drilling rig 1 and comprises a base structure, laid on ground "G", and a ramp whereon drilling element "P" can slide, at least partially, while moving towards or away from said drill floor 13. Said ramp is interposed between said drill floor 13 and said base structure of catwalk 16. No further details about the general characteristics of drilling rig 1 will be provided herein, since they are per se known to a person skilled in the art.

Figure 5B:
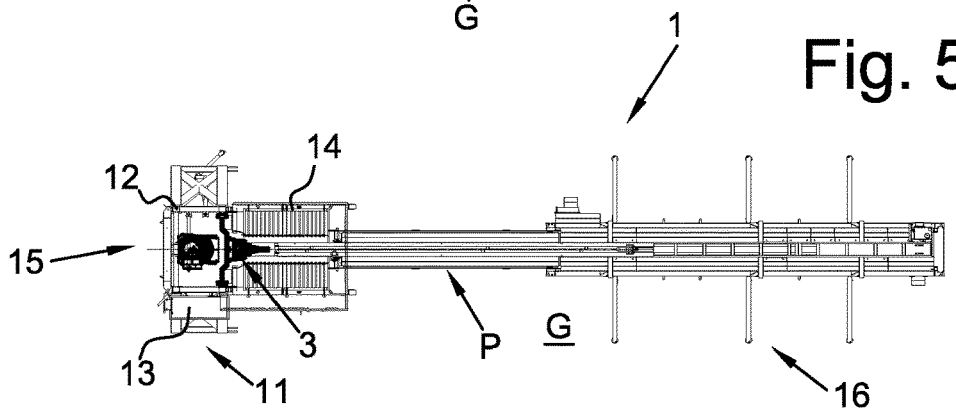

FIG. 5B shows a top view of the same drilling rig 1 of FIG. 5A. From the sequence of FIGS. 5A and 5B one can infer numerous implementation details of drilling rig 1 according to the present invention, which are easily discernible by a person skilled in the art.

Figure 10B:
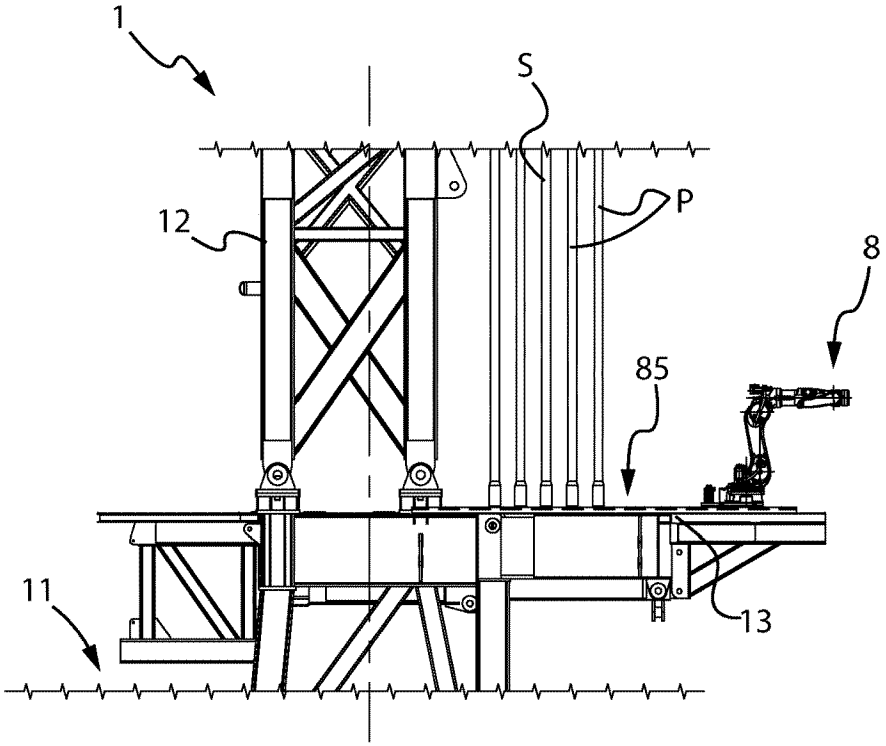
FIGS. 10A and 10B show different views of a robotized arm of a handling system on a drill floor; in particular.
Figure 10A:
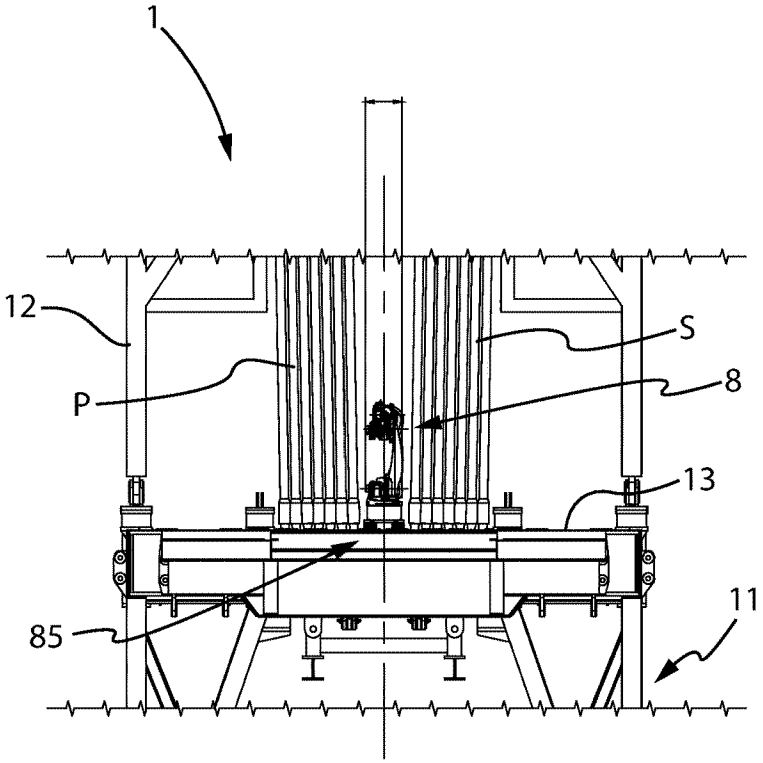

FIG. 10A shows a front view of drill floor 13 and robotized arm 8 in one possible operating configuration.

In this figure one can see that robotized arm 8 takes up little room on drill floor 13. Although it is capable of seizing and handling one end of a drilling element "P", in particular of a series "S" of drilling elements "P", said robotized arm 8 has compact dimensions. Said robotized arm co-operates with handler 3 to constitute the handling system, so as to facilitate moving drilling elements "P" from said fingerboard 14 to a well, e.g. main well "H" or mouse hole "M", and vice versa.

FIG. 10B shows robotized arm 8 placed on drill floor 13 of FIG. 10A in a side view.

Unlike FIG. 10A, this figure allows appreciating the compact dimensions of said robotized arm 8 compared to the other elements comprised in drilling rig 1 according to the present invention. Robotized arm 8 according to the present invention has preferably four degrees of freedom.

Figure 11B:
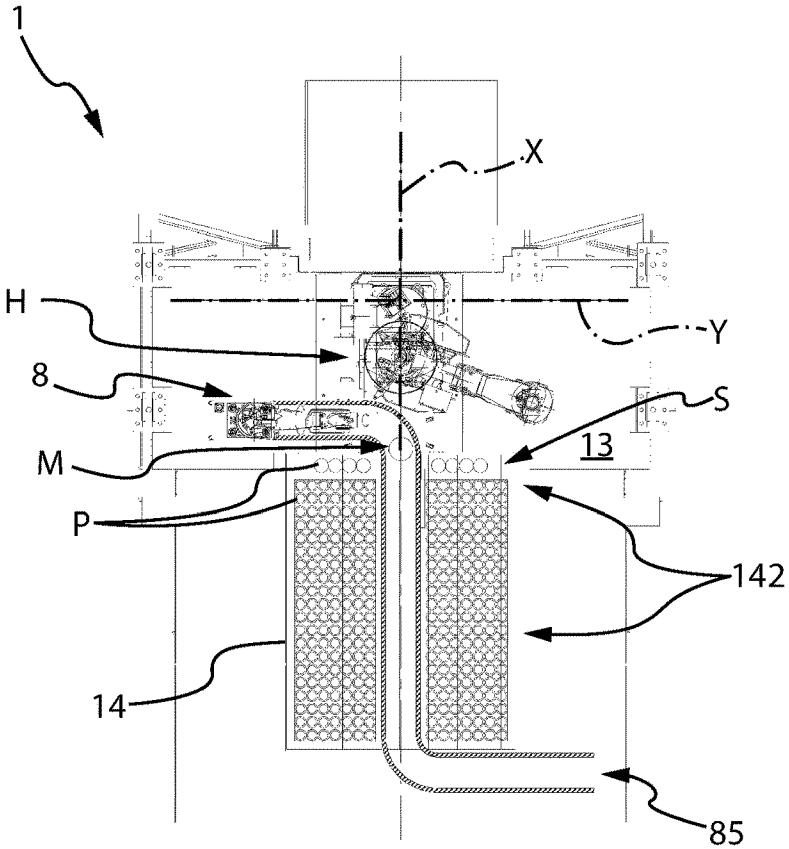
FIGS. 11A, 11B are top plane views of the robotized arm in different configurations and positions on the drill floor; in particular.
Figure 11A:
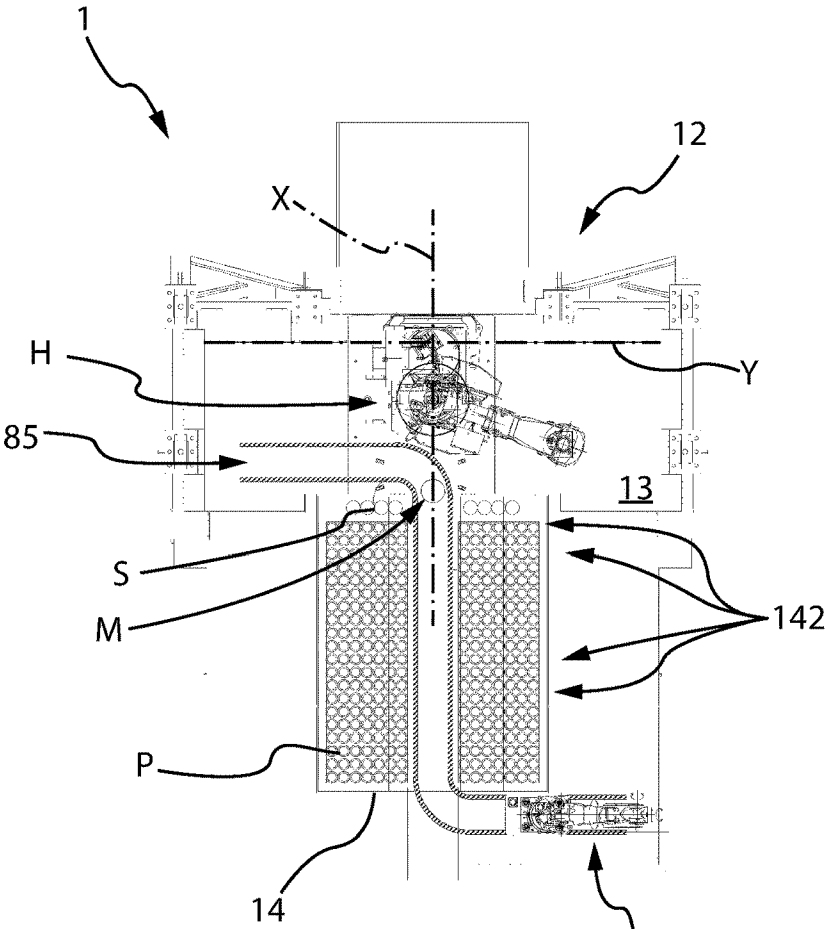

FIG. 11A shows robotized arm 8 in a first configuration at a first end of guide 85.

One possible embodiment of guide 85 is visible in this figure. This embodiment comprises two sections aligned with a third axis "Y", and a section aligned with said axis "X", connected to one another by curved portions.

Said section aligned with axis "X" is also aligned with an aisle comprised in fingerboard 14, where said handler 3 can move. The concordant movement of said robotized arm 8 and said handler 3 constitutes a handling system for moving drilling elements "P" from fingerboard 14 towards a well (M, H), and vice versa.

The configuration shown in FIG. 11A shows robotized arm 8 in a position in which it takes minimal room to reduce the hindrance that may be caused by robotized arm 8 during the various operating phases of drilling rig 1, such as, for example, the procedure for assembling or disassembling drilling elements "P".

FIG. 11B shows robotized arm 8 in a second configuration at a second end of guide 85.

By comparing FIG. 11A with FIG. 11B, it is possible to understand the movement of robotized arm 8 along said guide 85.

In particular, the configuration shown in FIG. 11B shows robotized arm 8 in a position that facilitates the handling of drilling elements "P" in proximity to the main well "H".

In general, multifunction handler 3 according to the present invention can be used for handling drilling elements "P", whether individually or assembled into series "S", during different operating phases of a drilling rig 1, i.e. both during the actual drilling phase, for the purpose of rapidly prearranging drilling elements "P" in a position accessible to top drive 15, and during a preparatory phase, for the purpose of assembling together several drilling elements "P" and creating a series "S" of drilling elements "P".

The present invention allows reducing the number of handlers included in a drilling rig 1, thus simplifying the management of drilling rig 1.

Multifunction handler 3 according to the present invention allows reducing the number and contribution of human operators on both drill floor 13 and fingerboard 14. This improves safety in drilling rig 1, reducing the number of accidents.

The handling system according to the present invention allows eliminating the need for human contribution on drill floor 13 and on fingerboard 14 when handling drilling elements "P", so that human presence can be eliminated on both drill floor 13 and fingerboard 14.

The handling system according to the present invention allows reducing those undesired effects which are typical of the handling of drilling elements "P" assembled into series, and in particular any oscillatory effects that may cause accidents on drill floor 13 and on fingerboard 14. Furthermore, the present invention allows increasing the speed at which drilling elements "P" are handled, thereby reducing the downtimes of drilling rig 1, particularly during the drilling phase. In fact, the present invention reduces the risk of triggering an oscillatory motion of drilling elements "P", which in prior-art solutions was normally controlled by moving drilling elements "P" very slowly.

The present invention allows for increased automation of drilling rigs 1, eliminating the risk of accidents involving human operators, in addition to reducing the downtimes of the rig and simplifying the operational management thereof.

Any alternative embodiments not described in detail herein, as well as any combinations of technical features, which may be easily inferred from the present description by a person skilled in the art, should be considered to fall within the scope of the present invention.

REFERENCE NUMERALS

Drilling rig 1
Control unit 10
Substructure 11
Mast 12
Rails 121
Drill floor 13
Fingerboard 14
Housing 142
Top drive 15
Catwalk 16
Clamp 17
Handler 3
Control system 32
Slide 4
Structure 40
Guide system 41
Lifting system 42
Articulated arm 5
First portion 51
Second portion 52
Actuators 53
Robotic apparatus 6
Electric motors 62
Handling head 7
Grippers 72
Handling device 73
Robotized arm 8
Guide 85
Ground G
Well centre H
Mouse hole M
Drilling elements P
Series S
Second axis X
Third axis Y
First axis Z

The invention claimed is:

1. A multifunction handler for a drilling rig comprising a mast and a top drive configured to slide along the mast; said handler comprising:

a slide comprising guides and a lifting system, said slide being adapted to slide along a first axis parallel to a longitudinal extension of the mast of the drilling rig, wherein said guides are configured for sliding along first rails on the mast, wherein said first rails are located at a front portion of the mast, between lateral faces of the mast, for sliding said slide along an entire longitudinal extension of the mast, said first rails being parallel to second rails for moving said top drive along the mast;

an articulated arm;

a robotic apparatus;

a handling head, adapted to at least seize, hold and release at least one drilling element; said articulated arm being fixed at a first end to said slide;

a first end of said robotic apparatus being fixed to a second end of said articulated arm;

said articulated arm being adapted to allow moving the robotic apparatus along at least a second axis perpendicular to said first axis;

said handling head being connected to a second end of the robotic apparatus;

said robotic apparatus being adapted to move said handling head with at least three degrees of freedom; said handler being configured for moving said handling head with at least five degrees of freedom;

said guides and said lifting system being arranged on a support structure of said slide;

said support structure of said slide being configured so the handler protrudes relative to a position in which guides are located, and to be clear of the top drive;

wherein said robotic apparatus comprises three or more electric motors, the electric motors being configured to operate on three distinct axes;

said handler comprising a control system configured to independently control said electric motors of the robotic apparatus;

wherein said handling head comprises at least one gripper configured to seize, hold, and release different types of drilling elements;

said handler being configured to seize, hold, and release an end of at least one drilling element or of a stand of drilling elements during a drilling phase of the drilling rig, a drilling element assembling phase, a drilling element disassembling phase, and moving of drilling elements.

2. The handler according to claim 1, wherein said robotic apparatus comprises:

a first electric motor adapted to cause said handling head to rotate about a first horizontal axis;

a second electric motor adapted to cause said handling head to rotate about a second horizontal axis, wherein said second horizontal axis is parallel to said first horizontal axis;

a third electric motor adapted to cause said handling head to rotate about a first vertical axis.

3. The handler according to claim 1, wherein said handler comprises a control system adapted to independently control movements of said slide, said articulated arm and said robotic apparatus.

4. The handler according to claim 1, said articulated arm comprising: actuators; a first portion; and a second portion, connected to each other to allow the robotic apparatus to move along the second axis, assuming at least two operating configurations, while keeping said second end of the articulated arm at a same height along a vertical axis.

5. The handler according to claim 4, wherein said articulated arm is an articulated arm with only one degree of freedom;

said handling head comprises a gripper handling device.

6. A handling system for handling drilling elements in a drilling rig in the absence of human operators on a drill floor and on a fingerboard of said drilling rig;

said handling system comprising: a robotized arm, adapted to slide along a guide arranged on said drill floor; and a multifunction handler according to claim 1.

7. The system according to claim 6, wherein:

said robotized arm is adapted to seize, hold and release the first end of at least one drilling element or of a stand of drilling elements.

8. The system according to claim 6, comprising a control unit adapted to at least control the relative movement of said handler and said robotized arm, to obtain mutually coordinated movements.

9. The system according to claim 6, wherein said guide extends on the drill floor, and comprises a first end proximal to a well, comprised in the drill floor, and to a mast, and a second end in a remote position relative to the mast-of the drilling rig.

10. A drilling rig comprising:

a handler according to claim 1;

a substructure adapted to be placed on a ground where drilling will take place;

the mast extending along a vertical axis;

a drill floor placed at a predefined height from the ground, on top of the substructure, from which said mast extends;

the top drive adapted to slide along said mast; said mast comprises, at a predefined height from the drill floor, a fingerboard for housing a plurality of racked drilling elements;

a catwalk adapted to move the drilling elements from the ground to the drill floor, and vice versa.

11. The rig according to claim 10, wherein said rig comprises automated systems and fluid circuits for reducing human operators on the drill floor and on the fingerboard.

12. A method of assembling drilling elements for creating a stand of drilling elements; said method of assembling comprising the following steps:

a) seizing a drilling element located on a drill floor by a catwalk;

b) lifting the drilling element relative to a vertical axis;

c) positioning the drilling element in a vertical position relative to said drill floor;

d) moving said drilling element towards a mouse hole;

e) inserting said drilling element into said mouse hole and holding the drilling element in the mouse hole;

f) repeating steps a) to d) to handle another drilling element;

g) bringing the drilling elements proximate each other and tightening the drilling elements together;

h) inserting said assembled drilling elements into said mouse hole and holding the drilling elements in the mouse hole;

i) repeating steps f) to h) to assemble another drilling element;

the steps of the present method being carried out by a handler according to claim 1, and a clamp or a power tong.

13. A method of moving drilling elements from a fingerboard towards a well of a drilling rig;

said method of moving being carried out by a handler according to claim 1;

said method of moving comprising the following steps:

i. seizing, through the handling head, a drilling element stored in a housing in the fingerboard;

ii. lifting said drilling element;

iii. moving said drilling element towards an area where said drilling element is spaced apart from other elements of the drilling rig;

iv. reversing orientation of said handling head, by rotating at least a part of the handler about at least one axis;

v. moving said drilling element and aligning said drilling element with an axis of said well;

vi. releasing the drilling element, which is retained by at least one retaining device at said well.

14. A method of moving drilling elements from a well towards a fingerboard of a drilling rig; said method of moving being carried out by a handler according to claim 1;

said method of moving comprising the following steps:

seizing, by the handling head, a drilling element retained by at least one retaining device at said well;

moving said drilling element away from an axis of said well and towards an area where said drilling element is spaced apart from said well;

reversing orientation of said handling head, by rotating at least a part of the handler about at least one axis;

moving said drilling element towards a housing in the fingerboard;

lowering said drilling element;

releasing said drilling element into the housing.

* * * * *